US009423721B2

(12) United States Patent
Murata et al.

(10) Patent No.: US 9,423,721 B2
(45) Date of Patent: Aug. 23, 2016

(54) DEVELOPING DEVICE, VISIBLE-IMAGE-FORMING DEVICE, AND IMAGE FORMING APPARATUS

(71) Applicant: FUJI XEROX CO., LTD., Tokyo (JP)

(72) Inventors: Shigemi Murata, Kanagawa (JP); Shinichi Kuramoto, Kanagawa (JP); Yoshitaka Nakajima, Kanagawa (JP); Ryota Tomishi, Kanagawa (JP); Shigeru Inaba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/790,080

(22) Filed: Jul. 2, 2015

(65) Prior Publication Data

US 2016/0070205 A1 Mar. 10, 2016

(30) Foreign Application Priority Data

Sep. 9, 2014 (JP) ..... 2014-183458
Mar. 26, 2015 (JP) ..... 2015-065270

(51) Int. Cl.
*G03G 15/08* (2006.01)

(52) U.S. Cl.
CPC ..... *G03G 15/0887* (2013.01)

(58) Field of Classification Search
CPC ..... G03G 15/0887; G03G 2215/0802
See application file for complete search history.

(56) References Cited

U.S. PATENT DOCUMENTS 8,676,098 B2 3/2014 Hirokawa et al.
2010/0098463 A1* 4/2010 Matsumoto ..... G03G 15/0921 399/254
2012/0195648 A1* 8/2012 Hirokawa ..... G03G 15/0815 399/272

FOREIGN PATENT DOCUMENTS

JP 2009-251197 A 10/2009
JP 2012-159741 A 8/2012

* cited by examiner

*Primary Examiner* — Sandra Brase
(74) *Attorney, Agent, or Firm* — Sughrue Mion, PLLC

(57) ABSTRACT

A developing device is provided. A rotating shaft of a first transporting member is positioned exactly below a developer carrier. A second virtual tangent to the first transporting member that extends vertically on a side of the first transporting member opposite an image carrier is farther from the image carrier than a first virtual tangent to the developer carrier that extends vertically on a side of the developer carrier opposite the image carrier. A distance between the two virtual tangents is shorter than a distance between the first virtual tangent and a developer container. A developer guiding member that guides a developer toward a downstream side in a direction of transport by the first transporting member is provided on a downstream side in a direction of rotation of the developer carrier with respect to the image carrier, with a gap provided with respect to the developer carrier.

11 Claims, 17 Drawing Sheets

DEVELOPING DEVICE, VISIBLE-IMAGE-FORMING DEVICE, AND IMAGE FORMING APPARATUS

CROSS-REFERENCE TO RELATED APPLICATIONS

This application is based on and claims priority under 35 USC 119 from Japanese Patent Application No. 2014-183458 filed Sep. 9, 2014, and Japanese Patent Application No. 2015-065270 filed Mar. 26, 2015.

BACKGROUND

Technical Field

The present invention relates to a developing device, a visible-image-forming device, and an image forming apparatus.

SUMMARY

According to an aspect of the invention, there is provided a developing device including a developer container that contains developer; a developer carrier provided in the developer container and that is rotatable while carrying the developer on a surface, the developer carrier facing an image carrier on which a latent image is to be formed; a first transporting member including a rotating shaft and a transporting blade supported by the rotating shaft, the first transporting member transporting the developer in the developer container while stirring the developer; and a second transporting member including a rotating shaft and a transporting blade supported by the rotating shaft, the second transporting member being provided side by side with the first transporting member, the second transporting member transporting the developer, while stirring the developer, in a direction opposite to a direction of transport by the first transporting member. The rotating shaft of the first transporting member is positioned in an area of projection defined by projecting the developer carrier from an upper side in a gravitational direction. Supposing that a first virtual tangent to an outer surface of the developer carrier extends in the gravitational direction on a side of the developer carrier opposite the image carrier and that a second virtual tangent to an outer edge of the transporting blade of the first transporting member extends in the gravitational direction on a side of the first transporting member opposite the image carrier, the second virtual tangent is farther from the image carrier in a horizontal direction than the first virtual tangent. Letting a distance in the horizontal direction between the first virtual tangent and the second virtual tangent be a first distance, and a distance in the horizontal direction between the first virtual tangent and an inner surface of the developer container on the side of the developer carrier opposite the image carrier be a second distance, the first distance is shorter than the second distance. A developer guiding member that guides the developer moving along the developer carrier is provided on a downstream side in a direction of rotation of the developer carrier with respect to a facing area where the developer carrier faces the image carrier. The developer guiding member faces the outer surface of the developer carrier with a gap interposed between the developer guiding member and the outer surface of the developer carrier. The developer guiding member includes an inclined portion that inclines from an upstream side in the direction of rotation of the developer carrier toward a downstream side in the direction of transport by the first transporting member.

BRIEF DESCRIPTION OF THE DRAWINGS

Exemplary embodiments of the present invention will be described in detail based on the following figures, wherein.

DETAILED DESCRIPTION

Figure 1:
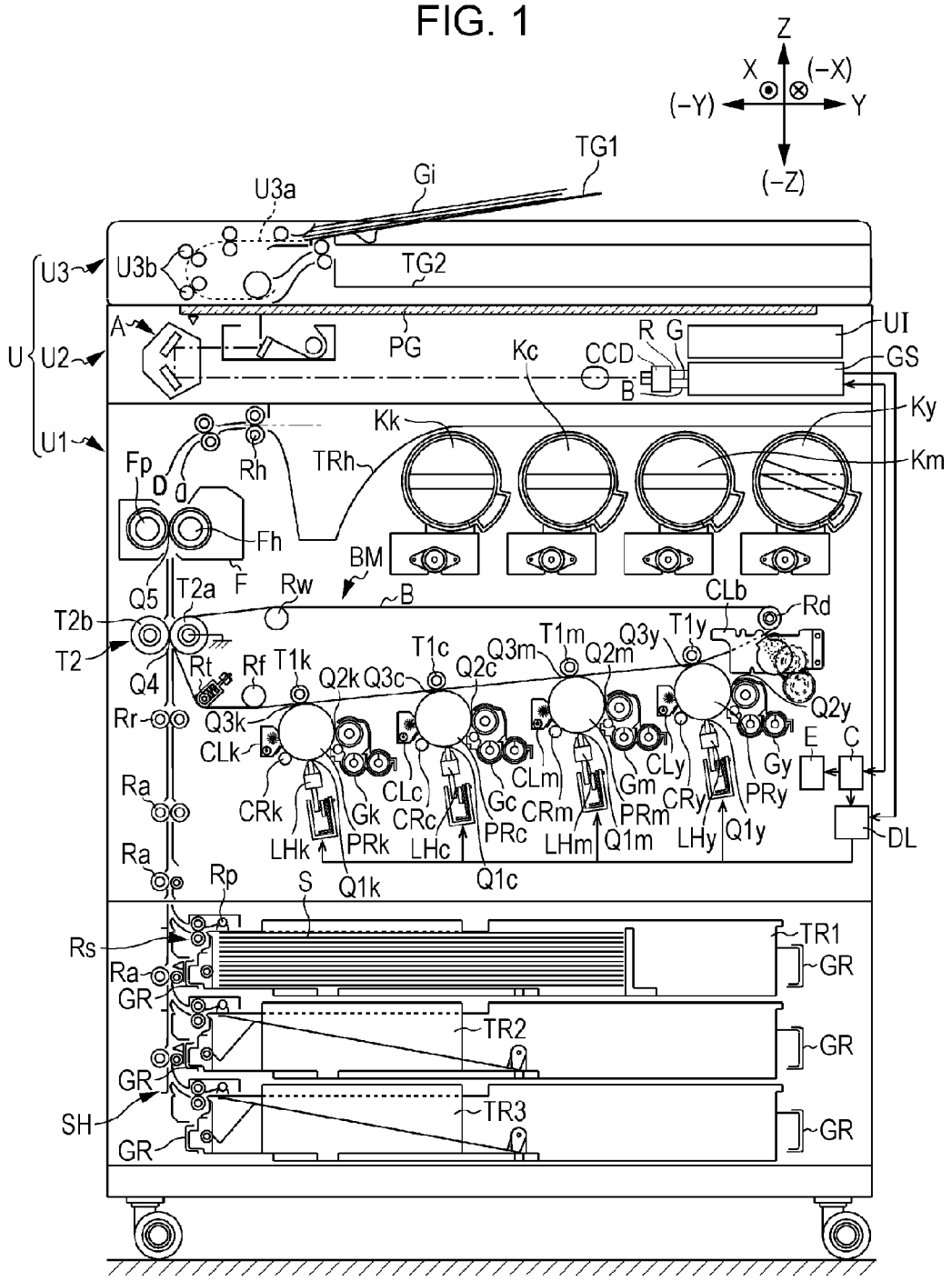
FIG. 1 illustrates an image forming apparatus according to a first exemplary embodiment.

Exemplary embodiments of the present invention will now be described with reference to the drawings. Note that the present invention is not limited to the following exemplary embodiments.

For easy understanding, directions and sides to be mentioned hereinafter referring to the drawings are defined as follows: the anteroposterior direction corresponds to the X-axis direction, the horizontal direction corresponds to the Y-axis direction, and the vertical direction corresponds to the Z-axis direction. Furthermore, arrows X, −X, Y, −Y, Z, and −Z point toward the front side, the rear side, the right side, the left side, the upper side, and the lower side, respectively.

A circle with a dot illustrated in each of relevant drawings represents an arrow pointing toward the near side from the far side of the drawing, and a circle with a cross illustrated in each of relevant drawings represents an arrow pointing toward the far side from the near side of the drawing.

Elements that are negligible in the following description are not illustrated in the drawings, for easy understanding.

First Exemplary Embodiment

FIG. 1 illustrates an image forming apparatus according to a first exemplary embodiment of the present invention.

Figure 2:
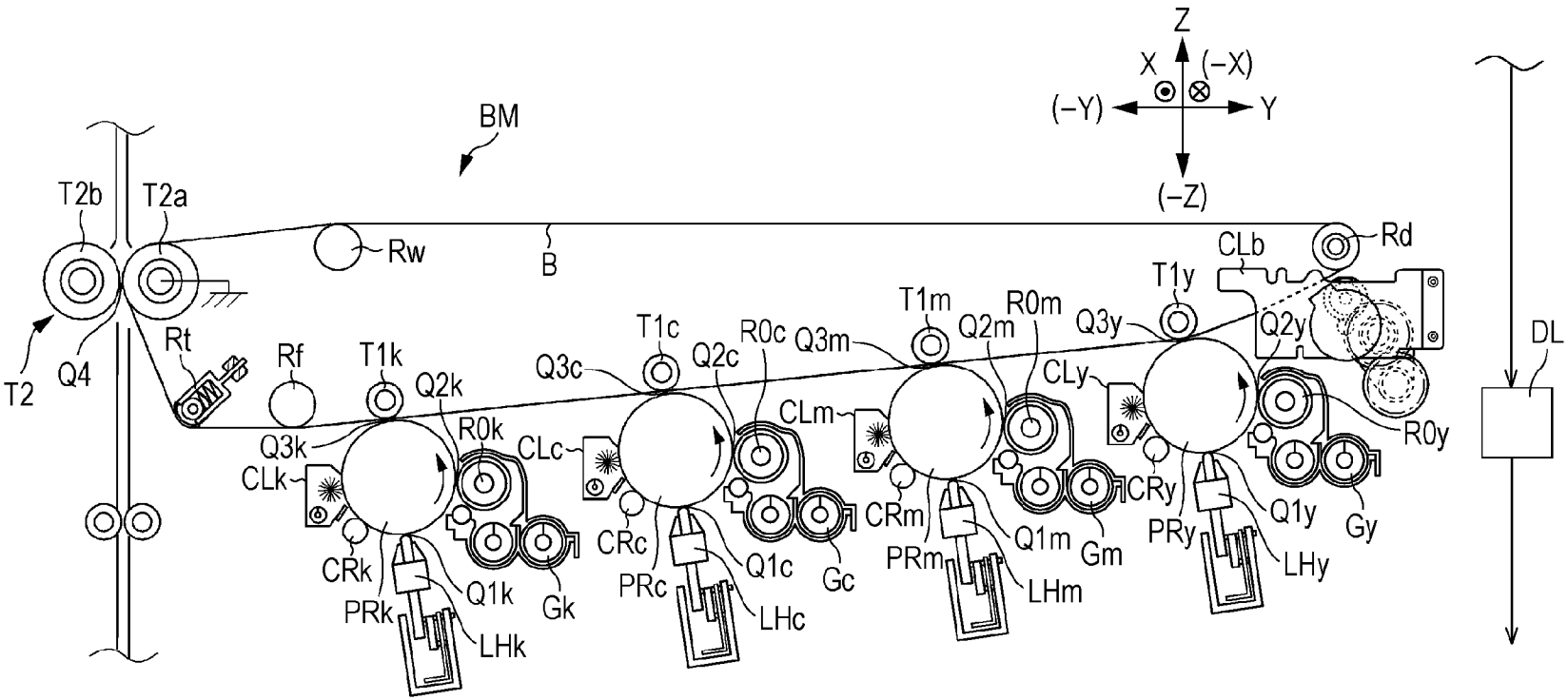
FIG. 2 illustrates relevant parts of the image forming apparatus according to the first exemplary embodiment.

FIG. 2 illustrates relevant parts of the image forming apparatus according to the first exemplary embodiment.

Referring to FIG. 1, a copier U as an exemplary image forming apparatus according to the first exemplary embodiment includes a printer unit U1 as an exemplary recording unit and as an exemplary image recording device. The printer unit U1 supports a scanner unit U2 as an exemplary reading unit and as an exemplary image reading device. The scanner unit U2 supports an automatic feeder U3 as an exemplary document transporting device. The scanner unit U2 according to the first exemplary embodiment also supports a user interface UI as an exemplary input unit. An operator operates the copier U by inputting relevant information on the user interface UI.

The automatic feeder U3 includes a document tray TG1 as an exemplary medium holder that is provided at the top thereof. The document tray TG1 holds a stack of plural pages of document Gi to be copied. The automatic feeder U3 also includes a document output tray TG2 as an exemplary document output portion that is provided below the document tray TG1. Pairs of document transporting rollers U3*b* are provided between the document tray TG1 and the document output tray TG2 and along a document transport path U3*a*.

The scanner unit U2 according to the first exemplary embodiment includes a platen glass PG as an exemplary transparent document table that is provided on the upper surface thereof, and a reading optical system A provided below the platen glass PG. The reading optical system A according to the first exemplary embodiment is supported in such a manner as to be movable in the horizontal direction along the lower surface of the platen glass PG. The reading optical system A is normally stationary at an initial position illustrated in FIG. 1.

An imaging device CCD as an exemplary imaging member is provided on the right side of the reading optical system A. The imaging device CCD is electrically connected to an image processing unit GS.

The image processing unit GS is electrically connected to a drawing circuit DL included in the printer unit U1. The drawing circuit DL is electrically connected to light-emitting-diode (LED) heads LHy, LHm, LHc, and LHk as exemplary latent-image-forming devices.

Photoconductor drums PRy, PRm, PRc, and PRk as exemplary image carriers are provided above the respective LED heads LHy, LHm, LHc, and LHk.

Charging rollers CRy, CRm, CRc, and CRk as exemplary charging devices are provided facing the respective photoconductor drums PRy, PRm, PRc, and PRk. A charging voltage is applied from a power supply circuit E to each of the charging rollers CRy, CRm, CRc, and CRk. The power supply circuit E is controlled by a controller C as an exemplary controller. The controller C performs control operations by transmitting and receiving signals to and from the image processing unit GS, the drawing circuit DL, and other associated elements.

The LED heads LHy, LHm, LHc, and LHk apply drawing beams to the surfaces of the photoconductor drums PRy, PRm, PRc, and PRk in drawing areas Q1*y*, Q1*m*, Q1*c*, and Q1*k*, respectively. The drawing areas Q1*y*, Q1*m*, Q1*c*, and Q1*k* are defined on the downstream side with respect to the charging rollers CRy, CRm, CRc, and CRk in a direction of rotation of the photoconductor drums PRy, PRm, PRc, and PRk, respectively.

Developing devices Gy, Gm, Gc, and Gk are provided facing the surfaces of the photoconductor drums PRy, PRm, PRc, and PRk in development areas Q2*y*, Q2*m*, Q2*c*, and Q2*k*, respectively. The development areas Q2*y*, Q2*m*, Q2*c*, and Q2*k* are defined on the downstream side with respect to the drawing areas Q1*y*, Q1*m*, Q1*c*, and Q1*k* in the direction of rotation of the photoconductor drums PRy, PRm, PRc, and PRk, respectively. Combinations of the photoconductor drums PRy, PRm, PRc, and PRk and the developing devices Gy, Gm, Gc, and Gk are regarded as process cartridges PRy+Gy, PRm+Gm, PRc+Gc, and PRk+Gk, respectively, as exemplary visible-image-forming devices.

First transfer areas Q3*y*, Q3*m*, Q3*c*, and Q3*k* are defined on the downstream side with respect to the development areas Q2*y*, Q2*m*, Q2*c*, and Q2*k* in the direction of rotation of the photoconductor drums PRy, PRm, PRc, and PRk, respectively. The photoconductor drums PRy, PRm, PRc, and PRk are in contact with an intermediate transfer belt B as an intermediate transfer body in the respective first transfer areas Q3*y*, Q3*m*, Q3*c*, and Q3*k*. First transfer rollers T1*y*, T1*m*, T1*c*, and T1*k* as exemplary first transfer devices are provided in the respective first transfer areas Q3*y*, Q3*m*, Q3*c*, and Q3*k* and across the intermediate transfer belt B from the respective photoconductor drums PRy, PRm, PRc, and PRk.

Drum cleaners CLy, CLm, CLc, and CLk as exemplary image-carrier-cleaning devices are provided on the downstream side with respect to the first transfer areas Q3*y*, Q3*m*, Q3*c*, and Q3*k* in the direction of rotation of the photoconductor drums PRy, PRm, PRc, and PRk, respectively.

A belt module BM as an exemplary intermediate transfer device is provided above the photoconductor drums PRy, PRm, PRc, and PRk. The belt module BM includes the intermediate transfer belt B. The intermediate transfer belt B is rotatably supported by a driving roller Rd as an exemplary driving member, a tension roller Rt as an exemplary stretching member, a walking roller Rw as an exemplary meandering correcting member, an idler roller Rf as an exemplary follower member, a backup roller T2*a* as an exemplary counter member provided in a second transfer area, and the first transfer rollers T1*y*, T1*m*, T1*c*, and T1*k*.

A second transfer roller T2*b* as an exemplary second transfer member is provided across the intermediate transfer belt B from the backup roller T2*a*. A combination of the backup roller T2*a* and the second transfer roller T2*b* is regarded as a second transfer device T2. An area where the second transfer roller T2*b* and the intermediate transfer belt B are in contact with each other is regarded as a second transfer area Q4.

A combination of the first transfer rollers T1*y*, T1*m*, T1*c*, and T1*k*, the intermediate transfer belt B, the second transfer device T2, and other associated elements is regarded as a transfer device T1+T2+B according to the first exemplary embodiment that transfers images formed on the photoconductor drums PRy, PRm, PRc, and PRk to a medium.

A belt cleaner CLb as an exemplary cleaning device for the intermediate transfer body is provided on the downstream side with respect to the second transfer area Q4 in a direction of rotation of the intermediate transfer belt B.

Cartridges Ky, Km, Kc, and Kk as exemplary developer containers are provided above the belt module BM. The cartridges Ky, Km, Kc, and Kk contain developers to be supplied to the developing devices Gy, Gm, Gc, and Gk, respectively. The cartridges Ky, Km, Kc, and Kk and the developing devices Gy, Gm, Gc, and Gk are connected to each other with developer supplying devices (not illustrated), respectively.

Sheet trays TR1 to TR3 as exemplary medium containers are provided at the bottom of the printer unit U1. The sheet trays TR1 to TR3 are each supported by guide rails GR as exemplary guide members in such a manner as to be detachable in the anteroposterior direction. The sheet trays TR1 to TR3 each contain sheets S as exemplary media.

A pickup roller Rp as an exemplary medium pickup member is provided on the upper left side of each of the sheet trays TR1 to TR3. A pair of separating rollers Rs as an exemplary separating member is provided on the left side of the pickup roller Rp.

A transport path SH along which each sheet S is transported extends upward on the left side of the sheet trays TR1 to TR3. Plural pairs of transporting rollers Ra as exemplary medium transporting members are provided along the transport path SH. A pair of registration rollers Rr as an exemplary feeding member is provided in a downstream portion of the transport path SH and on the upstream side with respect to the second transfer area Q4 in the direction of transport of the sheet S.

A fixing device F is provided above the second transfer area Q4. The fixing device F includes a heat roller Fh as an exemplary heating member, and a pressure roller Fp as an exemplary pressing member. An area where the heat roller Fh and the pressure roller Fp are in contact with each other is regarded as a fixing area Q5.

A pair of output rollers Rh as an exemplary medium transporting member is provided obliquely above the fixing device F. An output tray TRh as an exemplary medium output portion is provided on the right side of the pair of output rollers Rh.

Description of Image Forming Operation

Plural pages of document Gi held on the document tray TG1 sequentially pass through a document reading position on the platen glass PG and are sequentially outputted to the document output tray TG2.

If the document Gi is automatically transported and copied through the automatic feeder U3, the reading optical system A is stationary at the initial position and applies light to each of the pages of the document Gi that passes through the document reading position on the platen glass PG.

If the operator manually copies the document Gi by sequentially placing the plural pages of document Gi onto the platen glass PG, the reading optical system A moves in the horizontal direction while applying light to each of the pages of the document Gi that is placed on the platen glass PG, thereby scanning each of the pages of the document Gi.

Light reflected by the page of the document Gi travels through the reading optical system A and is focused on an imaging surface of the imaging device CCD. The imaging device CCD converts the light reflected by the page of the document Gi and focused on the imaging surface thereof into electrical signals for red R, green G, and blue B.

The image processing unit GS converts the electrical signals for R, G, and B inputted thereto from the imaging device CCD into pieces of image information for black K, yellow Y, magenta M, and cyan C and temporarily stores the pieces of image information. The image processing unit GS outputs the temporarily stored pieces of image information as pieces of image information for latent image formation to the drawing circuit DL at a predetermined timing.

If the image on the page of the document Gi is a monochrome image, only the piece of image information for black K is inputted to the drawing circuit DL.

The drawing circuit DL includes driving circuits (not illustrated) for the respective colors of Y, M, C, and K and outputs signals based on the pieces of image information inputted thereto to the LED heads LHy, LHm, LHc, and LHk for the respective colors at a predetermined timing.

The surfaces of the photoconductor drums PRy, PRm, PRc, and PRk are charged by the respective charging rollers CRy, CRm, CRc, and CRk. The LED heads LHy, LHm, LHc, and LHk form electrostatic latent images on the surfaces of the photoconductor drums PRy, PRm, PRc, and PRk in the drawing areas Q1*y*, Q1*m*, Q1*c*, and Q1*k*, respectively. The developing devices Gy, Gm, Gc, and Gk develop the electrostatic latent images on the surfaces of the photoconductor drums PRy, PRm, PRc, and PRk into toner images as exemplary visible images in the development areas Q2*y*, Q2*m*, Q2*c*, and Q2*k*, respectively. As the developers contained in the developing devices Gy, Gm, Gc, and Gk are consumed, fresh developers are supplied to the developing devices Gy, Gm, Gc, and Gk from the cartridges Ky, Km, Kc, and Kk, respectively, in accordance with the amounts of consumption.

The toner images on the surfaces of the photoconductor drums PRy, PRm, PRc, and PRk are transported to the respective first transfer areas Q3*y*, Q3*m*, Q3*c*, and Q3*k*. The power supply circuit E applies a first transfer voltage to each of the first transfer rollers T1*y*, T1*m*, T1*c*, and T1*k* at a predetermined timing. The first transfer voltage is of the opposite polarity to a toner contained in the developer. Hence, the first transfer voltage causes the toner images on the photoconductor drums PRy, PRm, PRc, and PRk to be sequentially transferred to the intermediate transfer belt B in the first transfer areas Q3*y*, Q3*m*, Q3*c*, and Q3*k*, respectively, such that the toner images are superposed one on top of another. If a monochrome image in the K-color is to be formed, only the toner image in the K-color is transferred from the photoconductor drum PRk for the K-color to the intermediate transfer belt B.

The toner images on the photoconductor drums PRy, PRm, PRc, and PRk are transferred for the first transfer to the intermediate transfer belt B as an exemplary intermediate transfer body by the respective first transfer rollers T1*y*, T1*m*, T1*c*, and T1*k*. Residual substances adhering to the surfaces of the photoconductor drums PRy, PRm, PRc, and PRk that have undergone the first transfer are removed by the respective drum cleaners CLy, CLm, CLc, and CLk. The surfaces of the photoconductor drums PRy, PRm, PRc, and PRk that have been thus cleaned are recharged by the respective charging rollers CRy, CRm, CRc, and CRk.

One of the sheets S contained in the sheet trays TR1 to TR3 is picked up by a corresponding one of the pickup rollers Rp at a predetermined timing of sheet feeding. If plural sheets S are picked up at a time by the pickup roller Rp, one of the sheets S is separated from the others by the pair of separating rollers Rs. The sheet S thus passed through the pair of separating rollers Rs is transported to the pair of registration rollers Rr by the plural pairs of transporting rollers Ra.

The pair of registration rollers Rr feeds the sheet S synchronously with the transport of the toner images on the intermediate transfer belt B to the second transfer area Q4.

When the sheet S thus fed from the pair of registration rollers Rr passes through the second transfer area Q4, a second transfer voltage is applied to the second transfer roller T2*b*, whereby the toner images on the surface of the intermediate transfer belt B are transferred to the sheet S.

Residual toner on the surface of the intermediate transfer belt B that has passed through the second transfer area Q4 is removed by the belt cleaner CLb.

The sheet S that has passed through the second transfer area Q4 then passes through the fixing area Q5, where the fixing device F applies heat and pressure to the toner images, thereby fixing the toner images.

The sheet S having the toner images fixed thereto is discharged to the output tray TRh by the pair of output rollers Rh.

Description of Developing Device

Figure 3:
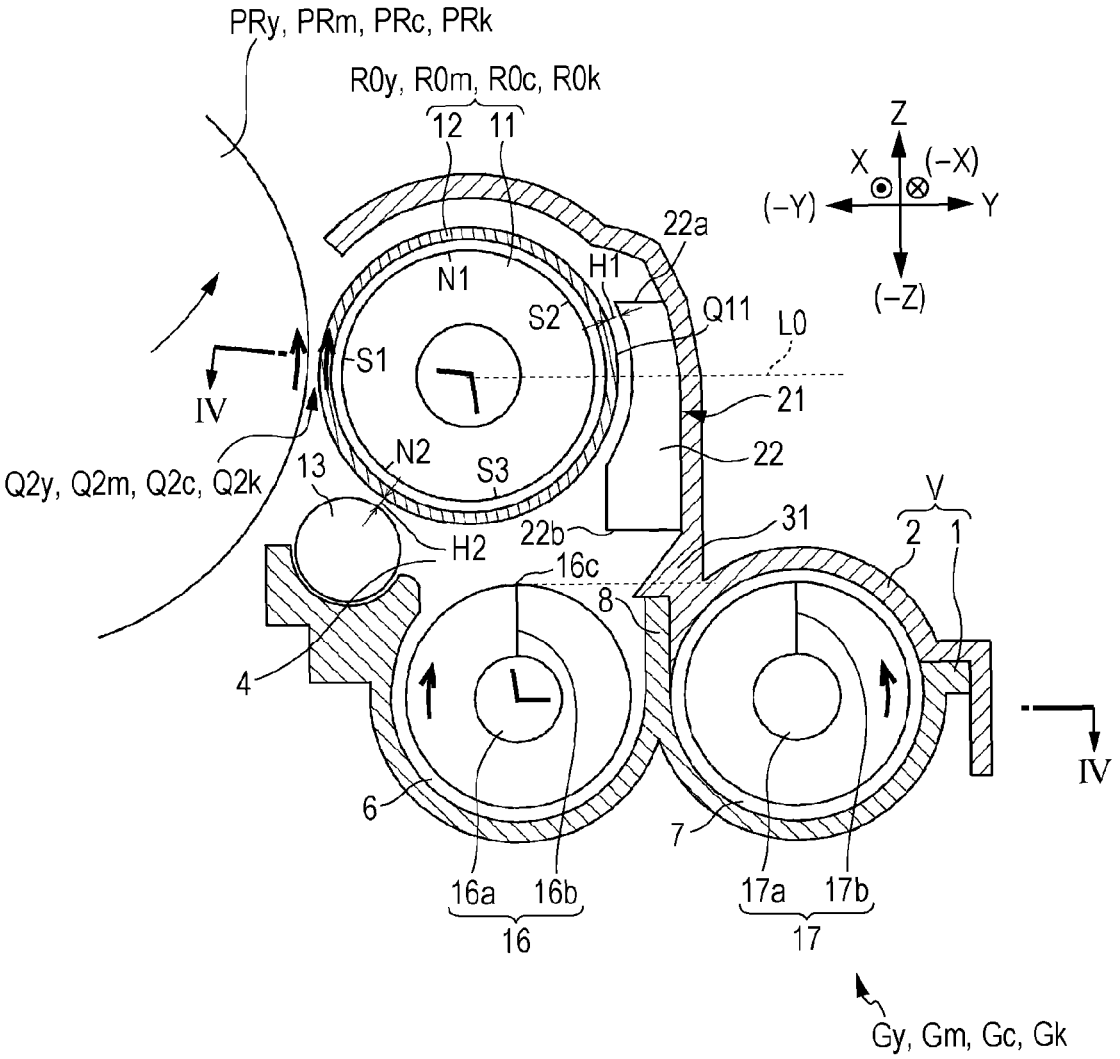
FIG. 3 illustrates a developing device according to the first exemplary embodiment.

FIG. 3 illustrates one of the developing devices Gy, Gm, Gc, and Gk according to the first exemplary embodiment.

Figure 4:
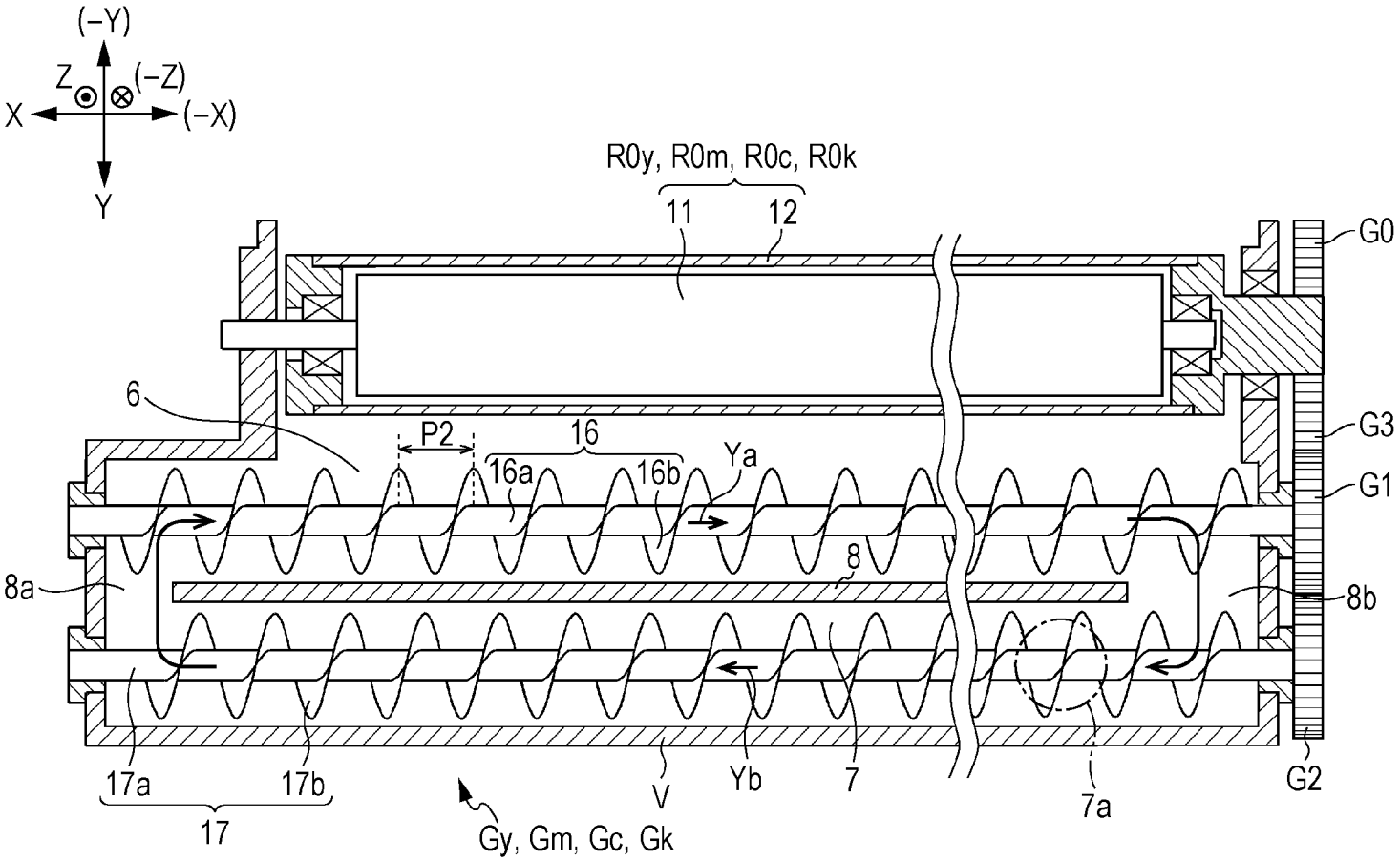
FIG. 4 is a sectional view taken along line IV-IV illustrated in FIG. 3.

FIG. 4 is a sectional view taken along line IV-IV illustrated in FIG. 3.

The developing devices Gy, Gm, Gc, and Gk according to the first exemplary embodiment of the present invention will now be described. The developing devices Gy, Gm, Gc, and Gk for the respective colors all have the same configuration. Therefore, the developing device Gy for the Y-color will be described in detail herein, and detailed description of the other developing devices Gm, Gc, and Gk is omitted.

Referring to FIGS. 3 and 4, the developing device Gy provided facing the photoconductor drum PRy includes a developer container V that contains a two-component developer composed of a toner and a carrier. Referring to FIG. 3, the developer container V includes a lower container body 1, and a container covering 2 as an exemplary covering member that is provided over the lower container body 1.

Referring to FIGS. 3 and 4, the lower container body 1 provides a developing-roller chamber 4 as an exemplary developer-carrier housing that is provided in an upper left part thereof, and a supply chamber 6 as an exemplary first chamber that is provided below the developing-roller chamber 4. The supply chamber 6 is continuous with the developing-roller chamber 4. A stirring chamber 7 as an exemplary second chamber is provided on the right side of the supply chamber 6.

The supply chamber 6 and the stirring chamber 7 are separated from each other by a partition wall 8 as an exemplary partition member. Referring to FIG. 4, the partition wall 8 has a first port 8*a* as an exemplary first connecting portion that is provided in a front part thereof. The first port 8*a* connects the supply chamber 6 and the stirring chamber 7 to each other. In the first exemplary embodiment, the first port 8*a* is provided on the front side with respect to the front end of the developing-roller chamber 4. The partition wall 8 also has a second port 8*b* as an exemplary second connecting portion that is provided in a rear part thereof. The second port 8*b* also connects the supply chamber 6 and the stirring chamber 7 to each other.

The developing-roller chamber 4 houses a developing roller R0*y* as an exemplary developer carrier. The developing roller R0*y* is positioned such that an upper left portion of the outer surface thereof faces the photoconductor drum PRy. The developing roller R0*y* includes a magnet roller 11 as an exemplary magnet member. Referring to FIG. 4, the magnet roller 11 is unrotatably supported by the developer container V. Referring to FIGS. 3 and 4, a developing sleeve 12 as an exemplary rotating body is provided around the magnet roller 11. The developing sleeve 12 is rotatably supported by the developer container V. A gear G0 as an exemplary driving-force-transmitting member is supported at the rear end of the developing sleeve 12. The gear G0 receives a driving force from a motor (not illustrated) as an exemplary drive source. When the developing device Gy according to the first exemplary embodiment receives the driving force transmitted from the motor, the developing sleeve 12 rotates in a direction the same as a direction in which the surface of the photoconductor drum PRy moves in the development area Q2*y* as an exemplary facing area.

A trimmer 13 as an exemplary layer-thickness-regulating member is provided in a lower part of the developing-roller chamber 4. The trimmer 13 according to the first exemplary embodiment has a round columnar shape extending in the anteroposterior direction. The trimmer 13 is unrotatably supported with a predetermined gap provided with respect to the developing sleeve 12.

The magnet roller 11 has a development magnetic pole S1 at a position corresponding to the development area Q2*y*, and a trimming magnetic pole N2 as an exemplary layer-thickness-regulating magnetic pole at a position facing the trimmer 13. The trimming magnetic pole N2 is of the opposite polarity to the development magnetic pole S1. The magnet roller 11 also has a transport magnetic pole N1 and a pick-off magnetic pole S2. The transport magnetic pole N1 is of the opposite polarity to the development magnetic pole S1 and is provided on the downstream side with respect to the development magnetic pole S1 in the direction of rotation of the developing sleeve 12. The pick-off magnetic pole S2 is an exemplary developer-release magnetic pole and is provided on the downstream side with respect to the transport magnetic pole N1 in the direction of rotation of the developing sleeve 12. The pick-off magnetic pole S2 is of the opposite polarity to the transport magnetic pole N1. The magnet roller 11 also has a pickup magnetic pole S3 as an exemplary developer-attracting magnetic pole. The pickup magnetic pole S3 is provided on the downstream side with respect to the pick-off magnetic pole S2 and on the upstream side with respect to the trimming magnetic pole N2 in the direction of rotation of the developing sleeve 12. The pickup magnetic pole S3 is of the same polarity as the pick-off magnetic pole S2 but is of the opposite polarity to the trimming magnetic pole N2.

Referring to FIGS. 3 and 4, the supply chamber 6 houses a supply auger 16 as an exemplary first transporting member. The supply auger 16 includes a rotating shaft 16*a* extending in the anteroposterior direction, a helical transporting blade 16*b* provided around the rotating shaft 16*a*, and a gear G1 as an exemplary driving-force-transmitting member that is supported at the rear end of the rotating shaft 16*a*.

The stirring chamber 7 houses a stirring auger 17 as an exemplary second transporting member. As with the supply auger 16, the stirring auger 17 includes a rotating shaft 17*a*, a transporting blade 17*b*, and a gear G2.

The gear G1 included in the supply auger 16 is in mesh an intermediate gear G3, which is in mesh with the gear G0. The gear G2 of the stirring auger 17 is in mesh with the gear G1 of the supply auger 16.

Referring to FIG. 4, the stirring chamber 7 has a supply port 7*a* in a rear part thereof. The developer is supplied from the cartridge Ky to the stirring chamber 7 through the supply port 7*a*.

Function of Developing Device

In each of the developing devices Gy, Gm, Gc, and Gk configured as described above, when the image forming operation is started, the motor is activated and causes a corresponding one of the developing rollers R0*y*, R0*m*, R0*c*, and R0*k* to rotate. Accordingly, the augers 16 and 17 rotate. In the first exemplary embodiment, when the supply auger 16 rotates, the supply auger 16 transports the developer in the supply chamber 6 from the first port 8*a* toward the second port 8*b*, as illustrated by arrow Ya representing the direction of transport, while stirring the developer. The developer that has reached the second port 8*b* flows through the second port 8*b* into the stirring chamber 7. When the stirring auger 17 rotates, the stirring auger 17 transports the developer in the stirring chamber 7 from the second port 8*b* toward the first port 8*a*, as illustrated by arrow Yb, while stirring the developer. The developer that has reached the first port 8*a* flows through the first port 8*a* into the supply chamber 6. Thus, a combination of the supply chamber 6 and the stirring chamber 7 is regarded as a circulation chamber 6+7.

The developer in the supply chamber 6 is attracted to the developing sleeve 12 with the magnetic force exerted by the pickup magnetic pole S3. When the developer thus attracted to the developing sleeve 12 goes past the trimmer 13, only a predetermined amount of developer is allowed to pass through the gap between the trimmer 13 and the developing sleeve 12. The developer that has gone past the trimmer 13 is used for the development of the latent image on the photoconductor drum PRy, PRm, PRc, or PRk in the development area Q2*y*, Q2*m*, Q2*c*, or Q2*k*. Some of the developer that has not been used for the development is further transported while being kept attracted to the surface of the developing sleeve 12 by the effect of a magnetic field produced between the development magnetic pole S1 and the transport magnetic pole N1, a magnetic field produced between the transport magnetic pole N1 and the pick-off magnetic pole S2, and the like. In an area between the pick-off magnetic pole S2 and the pickup magnetic pole S3 that are of the same polarity, the magnetic force that attracts the developer to the developing sleeve 12 is reduced. Hence, the developer on the surface of the developing sleeve 12 is released from the developing sleeve 12 in the area between the pick-off magnetic pole S2 and the pickup magnetic pole S3 and returns to the circulation chamber 6+7. In the first exemplary embodiment, a position Q11 where the magnetic force that attracts the developer to the developing sleeve 12 is smallest is defined above a virtual horizontal line L0 passing through the center of rotation of the developing sleeve 12. Hence, the developer that has been released from the developing sleeve 12 tends to slide along the outer surface of the developing sleeve 12 and then falls off the developing sleeve 12.

Description of Individual Elements of Developing Device

Figure 5:
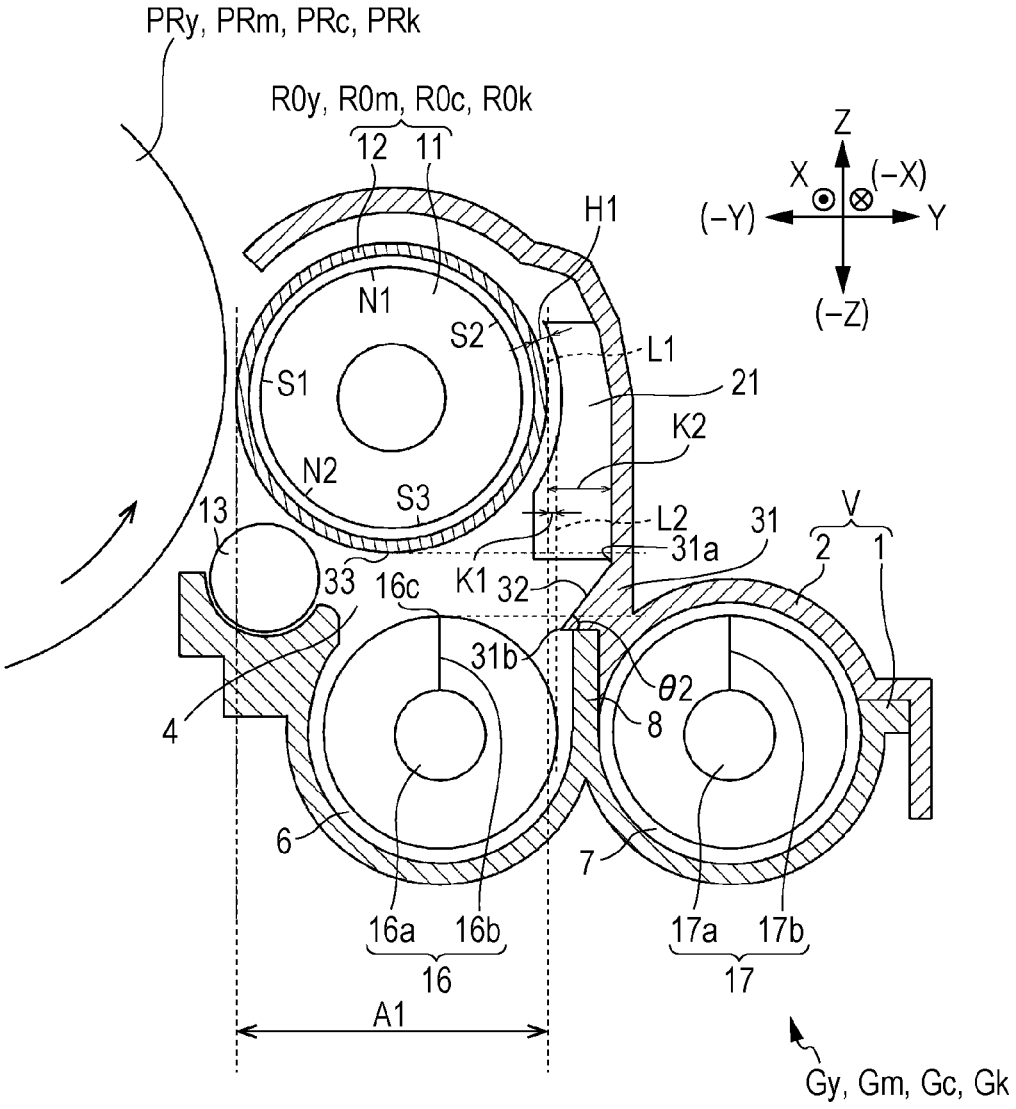
FIG. 5 illustrates the positional relationship among relevant elements according to the first exemplary embodiment and corresponds to FIG. 3.

FIG. 5 illustrates the positional relationship among relevant elements of the developing device Gy (or Gm, Gc, or Gk) according to the first exemplary embodiment, and corresponds to FIG. 3.

Referring to FIG. 5, in the developing device Gy according to the first exemplary embodiment, the rotating shaft 16*a* of the supply auger 16 is positioned in an area of projection A1 defined by projecting the developing roller R0*y* from the upper side in the gravitational direction.

As illustrated in FIG. 5, a tangent to the outer surface of the developing roller R0*y* that is on a side of the developing roller R0*y* opposite the photoconductor drum PRy and extends in the gravitational direction is denoted as a first virtual tangent L1. Furthermore, a tangent to the outer edge of the transporting blade 16*b* of the supply auger 16 that is on a side of the supply auger 16 opposite the photoconductor drum PRy and extends in the gravitational direction is denoted as a second virtual tangent L2. In the developing device Gy according to the first exemplary embodiment, the second virtual tangent L2 is farther from the photoconductor drum PRy than the first virtual tangent L1 in the horizontal direction.

As illustrated in FIG. 5, the horizontal-direction distance between the first virtual tangent L1 and the second virtual tangent L2 is denoted as a first distance K1. Furthermore, on the side of the developing roller R0*y* opposite the photoconductor drum PRy, the horizontal-direction distance between the first virtual tangent L1 and the inner surface of the developer container V is denoted as a second distance K2. In the developing device Gy according to the first exemplary embodiment, the first distance K1 is shorter than the second distance K2.

Hence, in the developing device Gy according to the first exemplary embodiment, the positions of the developing roller R0*y* and the supply auger 16 in the horizontal direction substantially coincide with each other. Accordingly, the developing device Gy according to the first exemplary embodiment has a smaller size than related-art developing devices.

Figure 6:
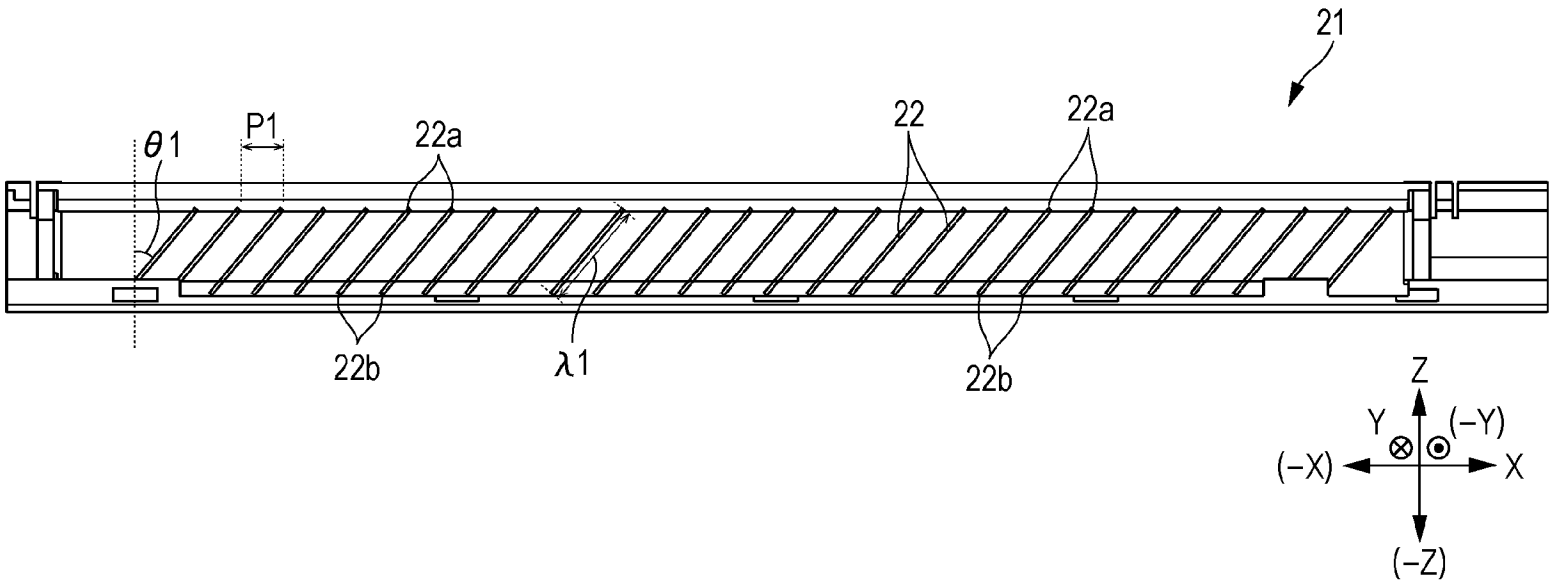
FIG. 6 illustrates a guiding-fin member according to the first exemplary embodiment.

FIG. 6 illustrates a guiding-fin member 21 according to the first exemplary embodiment.

Referring to FIGS. 5 and 6, the guiding-fin member 21 as an exemplary developer guiding member is provided on the side of the developing roller R0*y* opposite the photoconductor drum PRy. The guiding-fin member 21 according to the first exemplary embodiment is supported by the inner surface of the developer container V. The guiding-fin member 21 includes plural fins 22 as exemplary inclined portions. The fins 22 each project upright from the inner surface of the developer container V and are arranged side by side at a predetermined pitch P1 in the axial direction of the developing roller R0*y*. The fins 22 each incline from the upstream side thereof in the direction of rotation of the developing roller R0*y* toward the downstream side in the direction of transport Ya by the supply auger 16. That is, the fins 22 according to the exemplary embodiment each incline from the upper side thereof toward the downstream side of the supply chamber 6.

Referring to FIGS. 3 and 5, the tip of each of the fins 22 in the direction of projection thereof curves in an arc shape conforming to the developing sleeve 12, with a gap H1 provided with respect to the developing sleeve 12. In the first exemplary embodiment, the gap H1 is larger than a gap H2 between the trimmer 13 and the outer surface of the developing sleeve 12. The fins 22 are arranged within an area corresponding to the length of the outer surface of the developing sleeve 12 in the axial direction, i.e., the anteroposterior direction. While the first exemplary embodiment concerns a case where the fins 22 are arranged within the area corresponding to the length of the outer surface of the developing sleeve 12, the present invention is not limited to such a case. The fins 22 may be arranged in an area wider than the length of the developing sleeve 12.

Figure 7A:
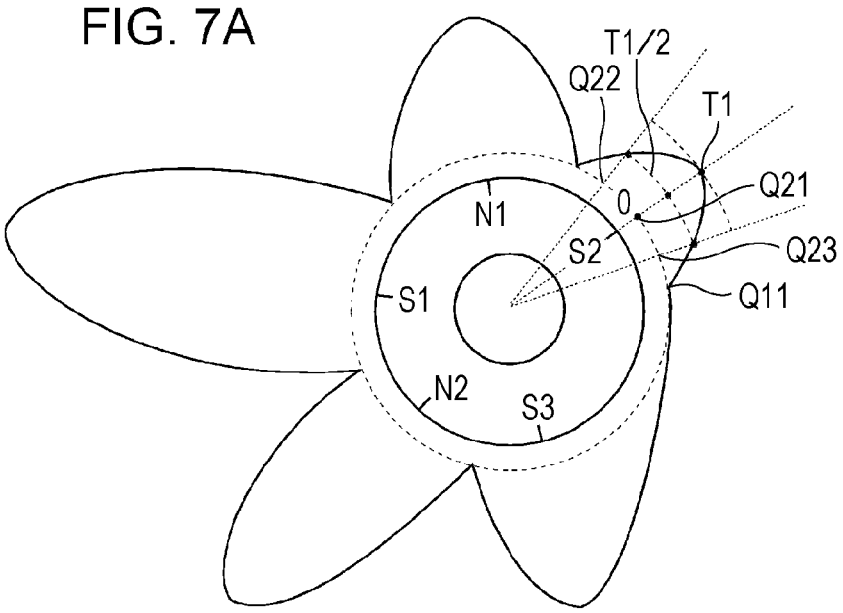
FIG. 7A illustrates the distribution of magnetic forces acting on a developing roller according to the first exemplary embodiment.
Figure 7B:
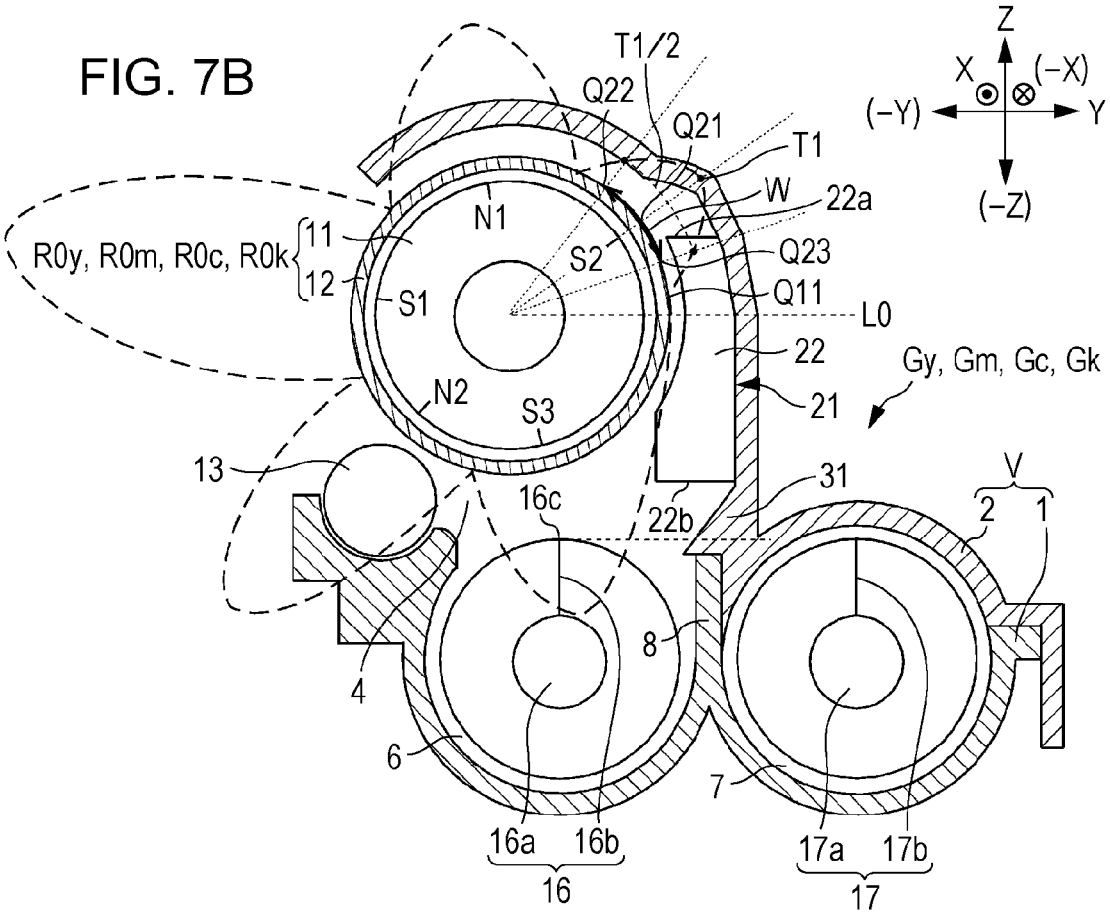
FIG. 7B illustrates the distribution of the magnetic forces with respect to the position of the guiding-fin member.

FIGS. 7A and 7B illustrate the position of the guiding-fin member 21 according to the first exemplary embodiment. FIG. 7A illustrates the distribution of magnetic forces acting on the developing roller R0*y* according to the first exemplary embodiment. FIG. 7B illustrates the distribution of the magnetic forces with respect to the position of the guiding-fin member 21.

FIG. 7A is a graph illustrating the distribution of the magnetic forces exerted by the respective magnetic poles S1, S2, S3, N1, and N2 of the magnet roller 11 of the developing roller R0*y* according to the first exemplary embodiment in the direction of rotation of the developing sleeve 12. In the graph, the magnitude of the magnetic forces in a direction normal to the surface of the magnet roller 11 corresponds to the length of the graph area in the radial direction of the developing roller R0*y*. The broken line illustrated in FIG. 7A represents the outer circumference of the developing sleeve 12. The farther the graph extends from the developing sleeve 12 in the radial direction, the larger the magnitude of the magnetic force becomes. Referring to FIGS. 7A and 7B, the magnetic force of the pick-off magnetic pole S2 becomes a maximum value T1 at a position Q21 and becomes a half value T1/2 of the maximum value T1 at each of a position Q22 and a position Q23 that are on the upstream side and the downstream side, respectively, of the position Q21 in the direction of rotation of the developing sleeve 12. In this specification and in the appended claims, the width of an area between the position Q22 and the position Q23 is referred to as half-value width W. Referring to FIG. 7B, an upper end 22*a*, as an exemplary upstream end in the direction of guiding of the developer, of each of the fins 22 of the guiding-fin member 21 according to the first exemplary embodiment is positioned within the area defined by the half-value width W. That is, the upper end 22*a* faces a position on the outer surface of the developing sleeve 12 in the area defined by the half-value width W. In addition, a lower end 22*b*, as an exemplary downstream end in the direction of guiding of the developer, of the fin 22 according to the first exemplary embodiment is positioned on the lower side with respect to the position Q11 where the magnetic force is smallest.

Referring now to FIGS. 5 and 6, the fins 22 of the guiding-fin member 21 according to the first exemplary embodiment are arranged at the pitch P1, which is shorter than a pitch P2 of turns in the transporting blade 16*b* of the supply auger 16. Referring to FIG. 6, the fins 22 each incline with respect to a direction orthogonal to the axial direction of the developing roller R0*y* by an angle of inclination θ1, which is set to, for example, 30 degrees. While the first exemplary embodiment concerns a case where the angle of inclination θ1 is 30 degrees, the present invention is not limited to such a case. The angle of inclination θ1 may be set to any angle, as long as the fins 22 each incline from the upstream side thereof in the direction of rotation of the developing roller R0*y* toward the downstream side in the direction of transport Ya by the supply auger 16. In such a configuration, the angle of inclination θ1 may be set to 20 degrees or about 20 degrees or larger and smaller than or equal to the complementary angle of the angle of repose of the developer. If the angle of inclination θ1 is smaller than 20 degrees, the fin 22 extends almost orthogonally to the axial direction of the developing roller R0*y*, making it difficult to guide the developer toward the downstream side in the direction of transport Ya. On the other hand, if the angle of inclination θ1 is larger than the complementary angle of the angle of repose of the developer, the developer may accumulate on the fin 22, increasing the probability that the transport of the developer may be hindered.

Hence, the angle of inclination θ1 is more preferably 30 degrees or larger and smaller than or equal to the complementary angle of the angle of repose of the developer. If the angle of inclination θ1 is 30 degrees or larger, the amount of developer to be guided toward the downstream side in the direction of transport Ya tends to become larger than in a case where the angle of inclination θ1 is smaller than 30 degrees. Note that the angle of repose of the developer varies with the kind of the developer and conditions, such as the temperature and the humidity, of the environment in which the developer is used. In the first exemplary embodiment, a developer whose angle of repose is 35 degrees is employed, for example. Hence, in the first exemplary embodiment, the complementary angle of the angle of repose of the developer is 55 degrees, which is obtained by subtracting 35 degrees from the right angle. The fin 22 has a length λ1, which is set such that λ1·(sin θ1) is larger than the pitch P2 of the turns in the transporting blade 16*b* of the supply auger 16. That is, the length λ1 of the fin 22 according to the first exemplary embodiment satisfies a relationship of λ1>P2/(sin θ1).

Referring to FIG. 5, the developing device Gy according to the first exemplary embodiment includes a guide member 31 as an exemplary second developer guiding member. The guide member 31 is provided at the upper end of the partition wall 8 and guides the developer in a direction orthogonal to the axial direction of the developing roller R0*y*. That is, the guide member 31 is provided across the developing roller R0*y* from the photoconductor drum PRy.

The guide member 31 according to the first exemplary embodiment has an inclined surface 32 that inclines toward the rotating shaft 16*a* of the supply auger 16 from an upper end 31*a* thereof toward the lower side. The upper end 31*a* of the guide member 31 is positioned on the lower side with respect to a lower end 33 of the developing roller R0*y* in the gravitational direction.

A lower end 31*b* of the guide member 31 in the gravitational direction is positioned on the upper side with respect to the rotating shaft 16*a* of the supply auger 16. That is, the lower end 31*b* of the guide member 31 is at a position higher than the rotating shaft 16*a* of the supply auger 16. In the first exemplary embodiment, the position of the lower end 31*b* is lower than an upper edge 16*c* of the transporting blade 16*b* of the supply auger 16.

In the first exemplary embodiment, the lower end 31*b* of the guide member 31, i.e., the lower end 31*b* of the inclined surface 32, is positioned nearer to the inner surface of the developer container V in the horizontal direction than the second virtual tangent L2.

In the first exemplary embodiment, an angle of inclination θ2 of the inclined surface 32 of the guide member 31 with respect to the horizontal direction is set to a value larger than or equal to the angle of repose of the developer and smaller than 90 degrees, more specifically, 35 degrees or larger and smaller than 90 degrees.

Function of Guiding-Fin Member

In the developing device Gy according to the first exemplary embodiment that is configured as described above, when the augers 16 and 17 rotate, the developer is transported and circulates in the circulation chamber 6+7. In the supply chamber 6, the supply auger 16 rotates, whereby the developer is transported in the direction of transport Ya. Some of the developer in the supply chamber 6 is attracted to the developing sleeve 12 with the magnetic force exerted by the pickup magnetic pole S3. The rest of the developer in the supply chamber 6 is further transported toward the downstream side in the direction of transport Ya. The developer attracted to the developing sleeve 12 is carried by the developing sleeve 12 that rotates. With the rotation of the developing sleeve 12, the developer passes through the development area Q2*y*, whereby the latent image on the photoconductor drum PRy is developed, and the toner contained in the developer is consumed. The resulting developer whose toner has been consumed is further carried with the rotation of the developing sleeve 12 toward the position Q11 where the magnetic force acting on the developing roller R0*y* is smallest. Since the magnetic force that attracts the developer to the developing sleeve 12 is reduced near the position Q11, the developer whose toner has been consumed is released from the developing sleeve 12.

The developer thus released from the developing sleeve 12 jumps, with a force of inertia, toward the guiding-fin member 21 provided on the right side of the position Q11 and above the supply chamber 6. The fins 22 of the guiding-fin member 21 each incline such that the lower end 22*b* thereof is positioned on the downstream side with respect to the upper end 22*a* in the direction of transport Ya. Hence, the developer that has entered the guiding-fin member 21 is guided along the fins 22 toward the downstream side in the direction of transport Ya while moving downward with the gravitational force or the like. Thus, the developer that has entered the guiding-fin member 21 passes through the guiding-fin member 21 while moving toward the downstream side in the direction of transport Ya with respect to the position of release. That is, in the first exemplary embodiment, the developer returns to the supply chamber 6 after being transported toward the downstream side in the direction of transport Ya. In the first exemplary embodiment, the guide member 31 is provided below the guiding-fin member 21. The guide member 31 receives the developer dropping from the guiding-fin member 21 and guides the dropped developer into the supply chamber 6. The developer that has returned to the supply chamber 6 is mixed with a mass of developer transported from the upstream side and the like, and the mixture is further transported in the direction of transport Ya.

The upper end 22*a* of each of the fins 22 of the guiding-fin member 21 according to the first exemplary embodiment is positioned in the area defined by the half-value width W. Hence, even if the position of the pick-off magnetic pole S2 is displaced because of any dimensional errors, the guiding-fin member 21 is positioned on the lateral side of the position Q11. Therefore, in the first exemplary embodiment, the developer that has been released from the developing sleeve 12 tends to enter the guiding-fin member 21, regardless of the dimensional errors of the associated elements. In the first exemplary embodiment, the gap H1 is provided between the guiding-fin member 21 and the developing sleeve 12. Hence, the wear of the developing sleeve 12 is suppressed more than in a case where the guiding-fin member 21 is in contact with the developing sleeve 12. Particularly, in the first exemplary embodiment, the gap H1 is larger than the gap H2. Hence, the guiding-fin member 21 according to the first exemplary embodiment is less likely to come into contact with the developer that is carried by the developing sleeve 12. Consequently, in the first exemplary embodiment, the scattering of the developer, i.e., the generation of developer cloud, is suppressed.

The developer that has been attracted to the developing sleeve 12 and whose toner has been consumed in the development area Q2*y* is released from the developing sleeve 12 and returns to the supply chamber 6. The developer that has returned to the supply chamber 6 is transported toward the downstream side in the direction of transport Ya by the supply auger 16. The developer that has been transported to the downstream side in the direction of transport Ya is attracted to the developing sleeve 12 again. Then, after the toner contained in the developer is consumed in the development area Q2*y*, the developer returns to the supply chamber 6. Thus, while the developer is transported from the upstream side to the downstream side of the supply chamber 6, the above cycle is repeated in which the developer is attracted to the developing sleeve 12, the toner of the developer is consumed in the development area Q2*y*, and the developer returns to the supply chamber 6. Hence, the consumption of toner from the developer in the supply chamber 6 increases toward the downstream side in the direction of transport Ya, resulting in a difference between the toner concentration of the developer on the upstream side and the toner concentration of the developer on the downstream side. If the difference in the toner concentration of the developer becomes large, the density of the developed image may become nonuniform, deteriorating the quality of the resulting image.

Figure 8A:
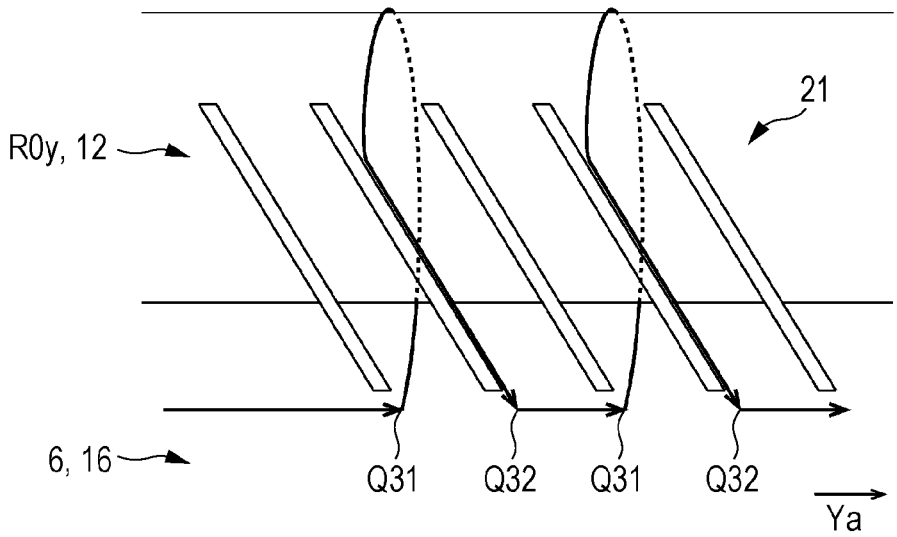
FIG. 8A illustrates a movement of developer in a case where the guiding-fin member is provided.
Figure 8B:
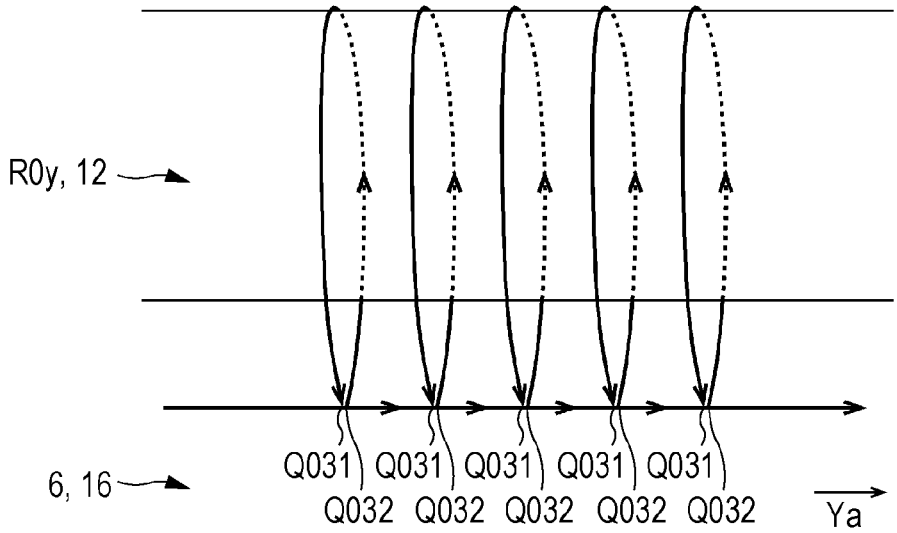
FIG. 8B illustrates a movement of developer in a comparative case where the guiding-fin member is not provided.

FIGS. 8A and 8B illustrate the movement of the developer. FIG. 8A illustrates a case where the guiding-fin member 21 is provided. FIG. 8B illustrates a comparative case where the guiding-fin member 21 is not provided.

In the comparative case illustrated in FIG. 8B where the guiding-fin member 21 is not provided, a position Q031 of the supply chamber 6 from which the developer is attracted to the developing sleeve 12 and the position Q032 of the supply chamber 6 to which the developer that has been released from the developing sleeve 12 returns are substantially the same in the direction of transport Ya. In contrast, according to the first exemplary embodiment illustrated in FIG. 8A, the developer that has been released from the developing sleeve 12 is guided by the guiding-fin member 21 and returns to a position Q32 of the supply chamber 6 that is on the downstream side in the direction of transport Ya with respect to a position Q31 of the supply chamber 6 from which the developer has been attracted to the developing sleeve 12. Thus, according to the first exemplary embodiment, the developer is transported toward the downstream side in the direction of transport Ya not only by the supply auger 16 but also by the guiding-fin member 21. Therefore, in the first exemplary embodiment, the developer tends to be transported quickly from the upstream side to the downstream side of the supply chamber 6, and the number of times for which the developer is attracted to the developing sleeve 12 tends to be small, correspondingly. Consequently, the consumption of toner from the developer tends to be small even on the downstream side of the supply chamber 6 in the direction of transport Ya. Accordingly, the difference between the toner concentration of the developer on the upstream side and the toner concentration of the developer on the downstream side, i.e., the difference in the toner concentration of the developer in the direction of transport Ya, tends to be small. Thus, according to the first exemplary embodiment, the difference in the toner concentration of the developer is made smaller than in a case where the developer that has passed through the development area is not moved in the direction of transport Ya.

The guiding-fin member 21 according to the first exemplary embodiment includes the fins 22 each inclining at the angle of inclination θ1 and that are arranged side by side at the pitch P1 in the direction of transport Ya. Hence, the distribution of the amount of developer guided by the guiding-fin member 21 according to the first exemplary embodiment is more even than in related-art developing devices in which the angle of inclination of guiding members varies with the positions of the guiding members. Moreover, the distribution of the number of fins 22 according to the first exemplary embodiment in the direction of transport Ya is more even than in the related-art developing devices. Therefore, in the first exemplary embodiment, the developer that has been released from the developing sleeve 12 is more likely to be transported toward the downstream side in the direction of transport Ya, regardless of the position in the axial direction of the developing roller R0*y*, before returning to the supply chamber 6. Thus, the probability that the developer whose toner has been consumed may return concentratedly to a certain area is reduced in the first exemplary embodiment. Accordingly, in the first exemplary embodiment, the probability that the toner concentration of the developer on the downstream side may be reduced so much as to make a noticeable variation in the toner concentration is smaller than in the related-art developing devices.

Furthermore, in the first exemplary embodiment, the angle of inclination θ1 is set to 30 degrees, which is smaller than or equal to the complementary angle of the angle of repose of the developer. Hence, in the first exemplary embodiment, the developer that is guided in the direction of transport Ya is less likely to accumulate on the fins 22 and to clog between adjacent ones of the fins 22.

Figure 9A:
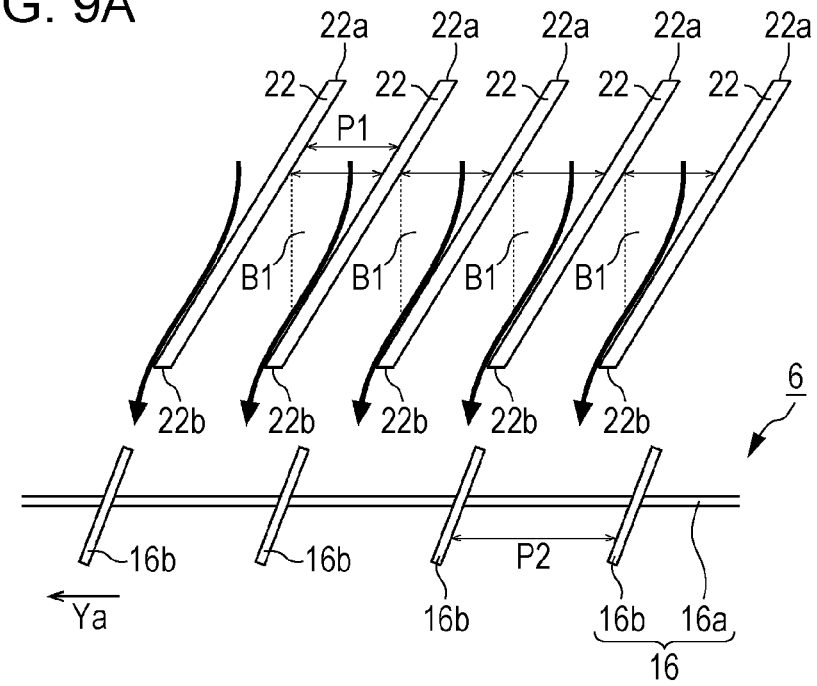
FIG. 9A illustrates the pitch of fins of the guiding-fin member and the amount of developer in the first exemplary embodiment.
Figure 9B:
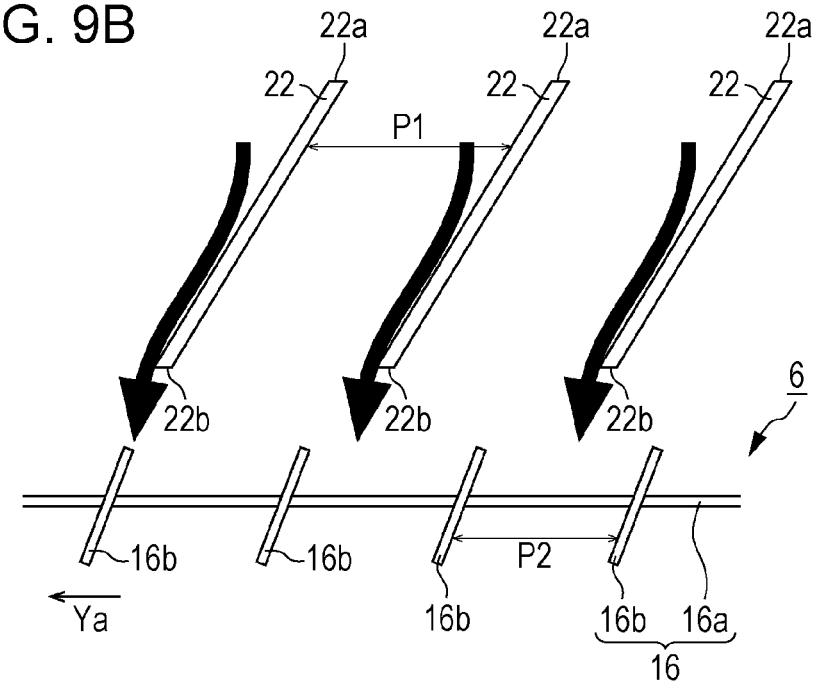
FIG. 9B illustrates the pitch of the fins of the guiding-fin member and the amount of developer in a comparative case where the pitch of the fins is larger than the pitch of turns in a transporting blade of a supply auger.

FIGS. 9A and 9B illustrate the pitch P1 of the fins 22 of the guiding-fin member 21 and the amount of developer. FIG. 9A illustrates the first exemplary embodiment. FIG. 9B illustrates a comparative case where the pitch P1 of the fins 22 of the guiding-fin member 21 is larger than the pitch P2 of the turns in the transporting blade 16*b* of the supply auger 16.

In the first exemplary embodiment, the pitch P1 of the fins 22 is smaller than the pitch P2 of the turns in the transporting blade 16*b* of the supply auger 16.

An amount of developer that corresponds to the size of the pitch P1 drops into the gap between adjacent ones of the fins 22 of the guiding-fin member 21. In the first exemplary embodiment, the lower end 22*b* of each of the fins 22 is positioned on the downstream side in the direction of transport Ya with respect to an area B1 into which the developer that has entered the guiding-fin member 21 drops. Hence, the developer that has entered the gap between adjacent ones of the fins 22 drops while being guided in the direction of transport Ya along one of the adjacent fins 22 and returns to a position of the supply chamber 6 that faces the lower end 22*b* of the fin 22.

Therefore, as the pitch P1 of the fins 22 becomes larger, a larger amount of developer enters the gap between adjacent ones of the fins 22 and the amount of developer guided by each fin 22 tends to increase. Moreover, as the pitch P1 becomes larger, positions of the supply chamber 6 to each of which the developer returns tend to become farther apart from one another. Hence, as the pitch P1 becomes larger, a larger amount of developer whose toner has been consumed tends to return to each of fewer positions of the supply chamber 6. Accordingly, it tends to take a long time for the toner concentration of the developer to be evened out, and the toner concentration of the developer is more likely to vary in the direction of transport Ya.

Figure 10A:
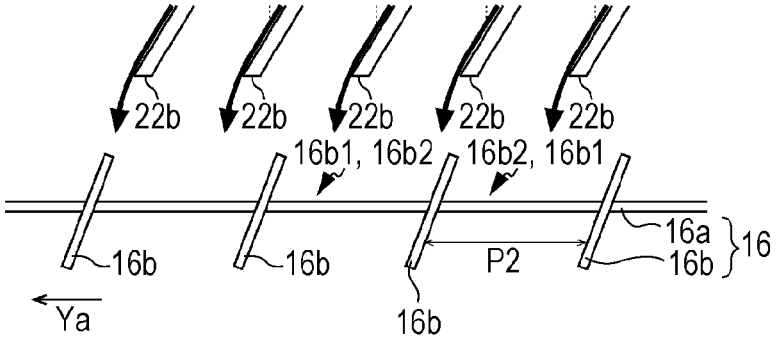
FIG. 10A illustrates the pitch of the fins and the way the developer is returned to a supply chamber in the first exemplary embodiment.
Figure 10B:
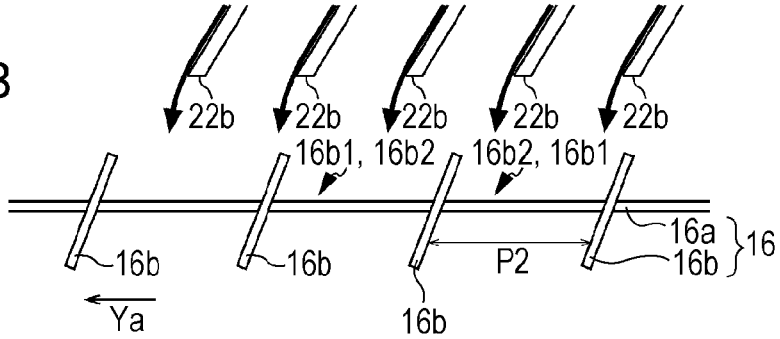
FIG. 10B illustrates a state where the supply auger according to the first exemplary embodiment has transported the developer by moving from the position illustrated in FIG. 10A.
Figure 10C:
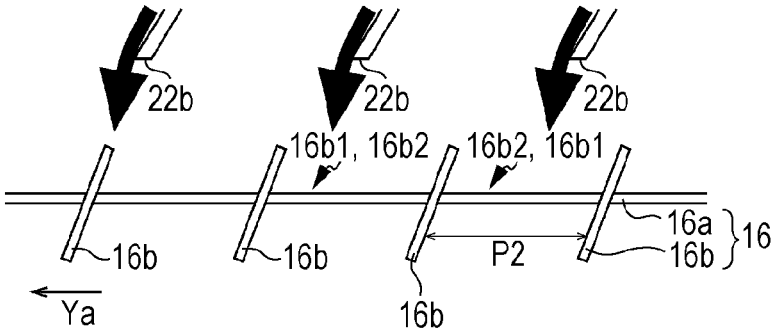
FIG. 10C illustrates the pitch of the fins and the way the developer is returned to the supply chamber in a comparative case where the pitch of the fins is larger than the pitch of turns in the transporting blade of the supply auger.
Figure 10D:
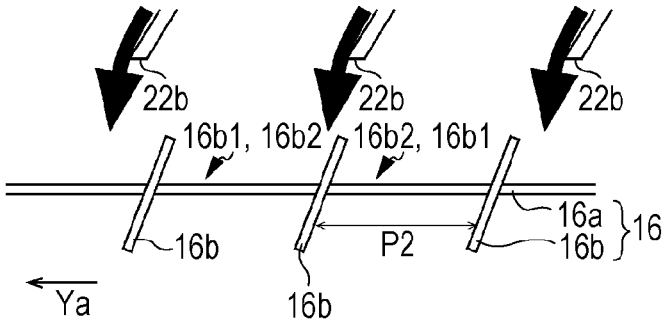
FIG. 10D illustrates a state where the supply auger according to the comparative case has transported the developer by moving from the position illustrated in FIG. 10C.

FIGS. 10A to 10D illustrate the pitch P1 of the fins 22 and the way the developer is returned to the supply chamber 6. FIG. 10A illustrates the first exemplary embodiment. FIG. 10B illustrates a state where the supply auger 16 has transported the developer by moving from the position illustrated in FIG. 10A. FIG. 10C illustrates an exemplary case where the pitch P1 of the fins 22 is larger than the pitch P2 of the turns in the transporting blade 16*b* of the supply auger 16. FIG. 10D illustrates a state where the supply auger 16 has transported the developer by moving from the position illustrated in FIG. 10C.

Particularly, in a case where the pitch P1 of the fins 22 is larger than the pitch P2 of the turns in the transporting blade 16*b* of the supply auger 16 as illustrated in FIGS. 10C and 10D, the developer may return to only one of two adjacent spaces 16*b*1 and 16*b*2 each defined by one turn of the transporting blade 16*b*, without returning to the other. The adjacent spaces 16*b*1 and 16*b*2 are separated from each other by the transporting blade 16*b*. When the supply auger 16 rotates, the spaces 16*b*1 and 16*b*2 move while being kept separated from each other. Therefore, the developer in the space 16*b*1 and the developer in the space 16*b*2 are less likely to be mixed together. Hence, if the developer returns to only one of the two adjacent spaces 16*b*1 and 16*b*2, the height of the mass of developer or the toner concentration of the developer may become different between that in the space 16*b*1 and that in the space 16*b*2. Consequently, defective attraction of the developer to the developing sleeve 12 or defective development on the photoconductor drum PRy that deteriorates the quality of the resulting image may occur depending on the length, i.e., the pitch P2, of the adjacent spaces 16*b*1 and 16*b*2.

In contrast, according to the first exemplary embodiment illustrated in FIGS. 9A, 10A, and 10B, the pitch P1 of the fins 22 is smaller than the pitch P2 of the turns in the transporting blade 16*b* of the supply auger 16. Since the pitch P1 is not too large, the developer tends to return to more positions of the supply chamber 6 by a smaller amount for each of the positions. That is, the developer whose toner has been consumed is distributed more evenly before returning to the supply chamber 6. Accordingly, the variation in the toner concentration of the developer in the direction of transport Ya is reduced.

Particularly, in the first exemplary embodiment in which the pitch P1 is smaller than the pitch P2, the developer is more likely to be distributed to each of the spaces 16*b*1 and 16*b*2 each defined by one turn of the transporting blade 16*b* of the supply auger 16. Therefore, in the first exemplary embodiment, the height of the mass of developer or the toner concentration of the developer is less likely to vary, and image quality is less likely to be deteriorated than in the case where the pitch P1 is larger than the pitch P2.

In the first exemplary embodiment, referring to FIG. 3, the developer that has passed through the guiding-fin member 21 tends to return to a side of the supply chamber 6 that is farther from the developing roller R0*y* than the rotating shaft 16*a* of the supply auger 16 in the horizontal direction. According to the first exemplary embodiment, in a sectional view taken orthogonally to the axial direction of the rotating shaft 16*a*, the supply auger 16 rotates in such a direction that the developer is transported sequentially from a position on the side farther from the developing roller R0*y*, to a position facing the bottom of the supply chamber 6, to a position on a side nearer to the developing roller R0*y*, and to a position where the developer is attracted to the developing sleeve 12. Hence, the developer just returned to the supply chamber 6 with its toner consumed is less likely to be supplied to the developing sleeve 12 before being mixed with the mass of developer in the supply chamber 6.

EXAMPLES

Experiments for demonstrating the effects produced by the first exemplary embodiment are conducted as follows.

The following experiments are conducted on several models of a printer called DocuCentre SC2020 of Fuji Xerox Co., Ltd. that have been modified for the experiments.

Experimental Example 1-1

In Experimental Example 1-1, modified developing devices Gy are used. Specifically, two developing devices Gy are prepared, with the amount of developer that is present around the augers 16 and 17 and the developing roller R0*y*, i.e., the amount of developer sump, being set to 135 g and 90 g, respectively. Each of the developing devices Gy includes the guiding-fin member 21. The length λ1 of each of the fins 22 of the guiding-fin member 21 is 25 mm. The pitch P1 of the fins 22 is 10 mm. The angle of inclination θ1 of each fin 22 is 40 degrees. Then, the difference in toner concentration ΔTC (%) in the supply chamber 6 is measured for each of the two developing devices Gy containing different amounts of developer. Specifically, an image with a density of 100%, i.e., a solid image, intended for size A3 is formed and is printed on twenty sheets S successively. Then, after the printing on the twenty sheets S is complete, the difference in toner concentration ΔTC (%) in each of the developing devices Gy is measured. More specifically, the toner concentration is measured at each of two predetermined positions of the supply chamber 6 that are space apart from each other in the direction of transport Ya, and the difference between the two measured values is taken as the difference in toner concentration ΔTC (%). In Experimental Example 1-1, the process speed is set to 126 mm/s. That is, the speed at which each sheet S passes through the second transfer area Q4 is set to 126 mm/s. Furthermore, the speed of rotation of the developing roller R0*y*, i.e., the speed of rotation of the developing sleeve 12, is set to 214.2 mm/s.

Experimental Example 1-2

In Experimental Example 1-2, the process speed is set to 63 mm/s. That is, the speed at which each sheet S passes through the second transfer area Q4 is set to 63 mm/s, and the speed of rotation of the developing sleeve 12 is set to 107.1 mm/s. The other conditions and the measurement method are the same as those employed in Experimental Example 1-1.

Comparative Example 1-1

In Comparative Example 1-1, the angle of inclination θ1 of each fin 22 is set to 0 degrees for each of three developing devices Gy that contain different amounts of developer of 135 g, 100 g, and 85 g, respectively. The other conditions and the measurement method are the same as those employed in Experimental Example 1-1.

Comparative Example 1-2

In Comparative Example 1-2, the angle of inclination θ1 of each fin 22 is set to 0 degrees for each of three developing devices Gy that contain different amounts of developer of 135 g, 100 g, and 85 g, respectively. The other conditions and the measurement method are the same as those employed in Experimental Example 1-2.

Results of Experiments in Experimental Examples 1-1 and 1-2 and Comparative Examples 1-1 and 1-2

Figure 11A:
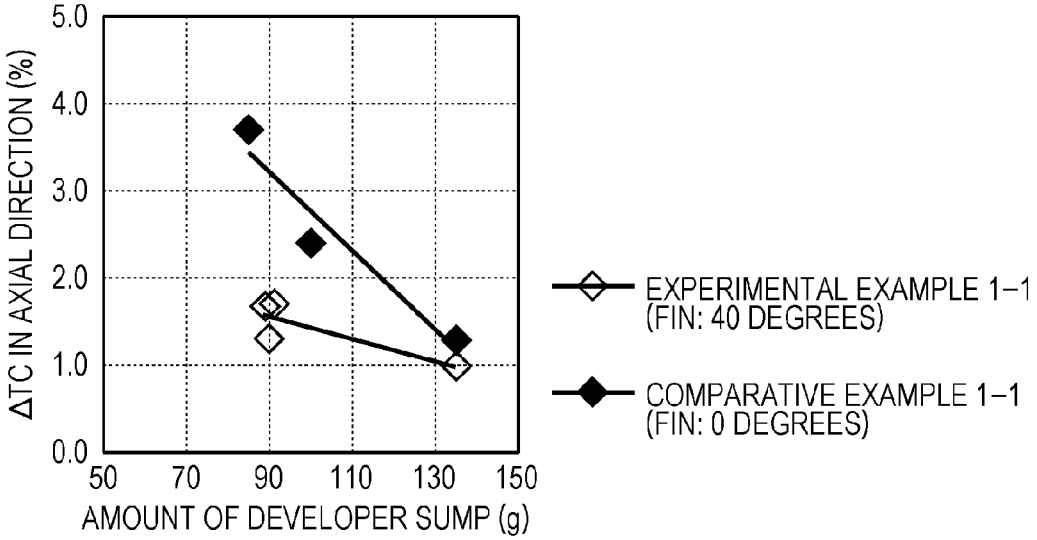
FIG. 11A is a graph illustrating the difference in toner concentration with respect to the amount of developer in Experimental Example 1-1 and Comparative Example 1-1 in each of which the process speed is 126 mm/s.
Figure 11B:
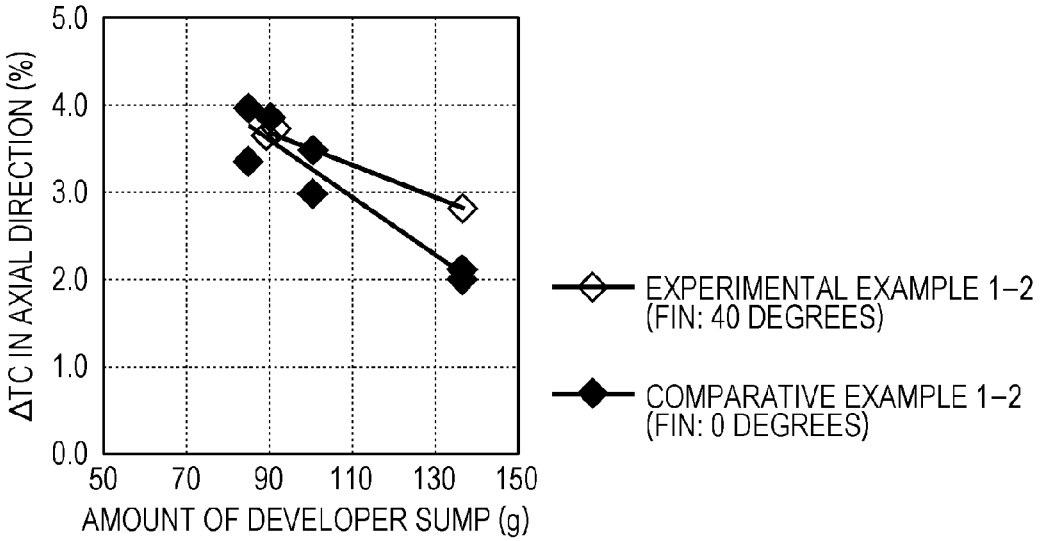
FIG. 11B is a graph illustrating the difference in toner concentration with respect to the amount of developer in Experimental Example 1-2 and Comparative Example 1-2 in each of which the process speed is 63 mm/s.

FIGS. 11A and 11B are graphs illustrating the results of the experiments conducted in Experimental Examples 1-1 and 1-2 and Comparative Examples 1-1 and 1-2. FIG. 11A illustrates the difference in toner concentration with respect to the amount of developer in Experimental Example 1-1 and Comparative Example 1-1 in each of which the process speed is 126 mm/s. FIG. 11B illustrates the difference in toner concentration with respect to the amount of developer in Experimental Example 1-2 and Comparative Example 1-2 in each of which the process speed is 63 mm/s.

Figure 12A:
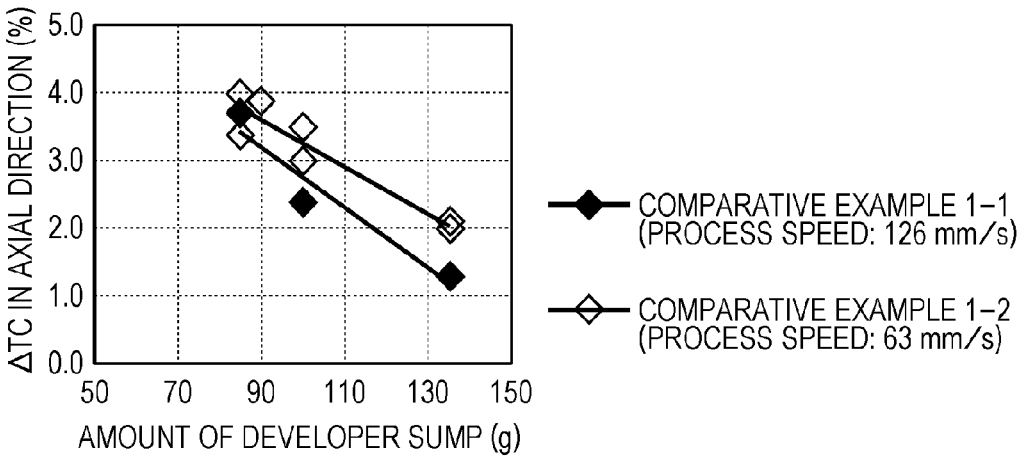
FIG. 12A is a graph illustrating the difference in toner concentration with respect to the amount of developer in Comparative Examples 1-1 and 1-2 in each of which the angle of inclination of each fin is 0 degrees.
Figure 12B:
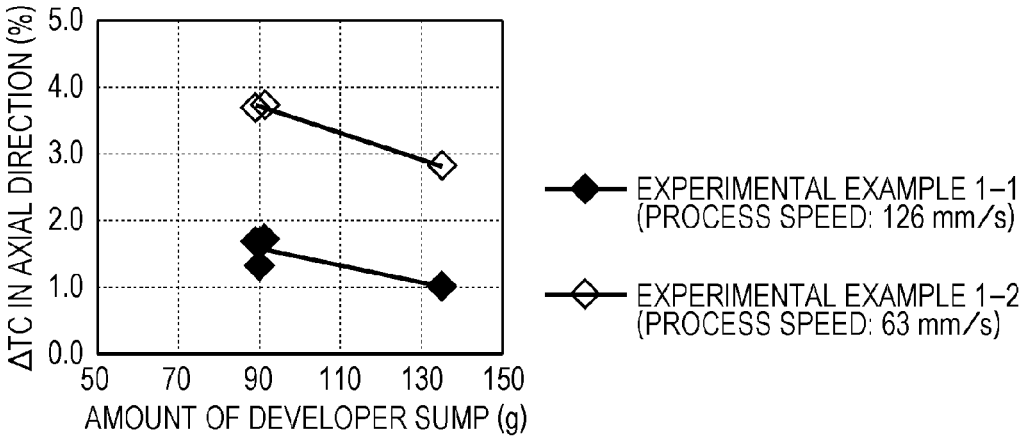
FIG. 12B is a graph illustrating the difference in toner concentration with respect to the amount of developer in Experimental Examples 1-1 and 1-2 in each of which the angle of inclination of each fin is 40 degrees.

FIGS. 12A and 12B are graphs illustrating the results of the experiments conducted in Comparative Examples 1-1 and 1-2 and Experimental Examples 1-1 and 1-2. FIG. 12A illustrates the difference in toner concentration with respect to the amount of developer in Comparative Examples 1-1 and 1-2 in each of which the angle of inclination θ1 is 0 degrees. FIG. 12B illustrates the difference in toner concentration with respect to the amount of developer in Experimental Examples 1-1 and 1-2 in each of which the angle of inclination θ1 is 40 degrees.

In the graphs illustrated in FIGS. 11A to 12B, the horizontal axis represents the amount of developer (g), and the vertical axis represents the difference in toner concentration ΔTC (%). The graphs illustrated in FIGS. 11A to 12B are plotted by obtaining measured values of the difference in toner concentration ΔTC (%) for the different amounts of developer in the respective developing devices Gy in each of Experimental Examples 1-1 and 1-2 and Comparative Examples 1-1 and 1-2. Thus, the relationship between the amount of developer and the difference in toner concentration is illustrated by an approximate line.

In general, in each of the developing devices Gy, Gm, Gc, and Gk, as the amount of developer contained therein becomes larger, the influence of toner consumption tends to become smaller and the difference in toner concentration ΔTC (%) therefore tends to become smaller. This tendency is understood from the fact that the gradients of the approximate lines obtained in Experimental Examples 1-1 and 1-2 and Comparative Examples 1-1 and 1-2 graphed in FIGS. 11A to 12B are all negative. That is, there is less problem with the difference in toner concentration ΔTC (%) if the amount of developer is large. Hence, the difference in toner concentration ΔTC (%) in the case where the amount of developer is small is desired to be close to the difference in toner concentration ΔTC (%) in the case where the amount of developer is large, and the change in the difference in toner concentration ΔTC (%) with respect to the change in the amount of developer is desired to be small. Referring to FIGS. 11A to 12B, the gradients of the approximate lines obtained in Experimental Examples 1-1 and 1-2 in which the angle of inclination θ1 of the fin 22 is 40 degrees are gentler than those obtained in Comparative Examples 1-1 and 1-2 in which the angle of inclination θ1 of the fin 22 is 0 degrees. That is, the change in the difference in toner concentration ΔTC (%) with respect to the change in the amount of developer is smaller in Experimental Examples 1-1 and 1-2 than in Comparative Examples 1-1 and 1-2. Accordingly, if the developing device Gy, Gm, Gc, or Gk has a small size and a correspondingly small capacity, the increase in the difference in toner concentration ΔTC (%) is suppressed by providing the guiding-fin member 21 including the inclined fins 22.

Furthermore, FIGS. 12A and 12B show that, in the case where the guiding-fin member 21 including the inclined fins 22 is provided, the difference in toner concentration ΔTC (%) tends to become smaller as the process speed is increased.

This is because of the following reason. When the process speed is increased, the speed of rotation of the developing sleeve 12 increases. Accordingly, the centrifugal force that acts on the developer on the developing sleeve 12 increases, and the speed at which the developer is released from the developing sleeve 12 tends to increase. Hence, when the developer is released from the developing sleeve 12, the developer easily reaches the guiding-fin member 21 and is easily guided along the guiding-fin member 21. Therefore, in the case where the process speed is high, the proportion of developer that returns to the supply chamber 6 after being guided along the guiding-fin member 21 is much larger than the proportion of developer that returns to the supply chamber 6 by vertically dropping downward with the gravitational force. Consequently, the difference in toner concentration ΔTC (%) of the developer is further reduced.

Experimental Example 2-1

In Experimental Example 2-1, a developing device Gy in which the amount of developer that is present around the augers 16 and 17 and the developing roller R0*y* is set to 180 g is used. The developing device Gy includes the guiding-fin member 21. The angle of inclination θ1 of each of the fins 22 is set to 50 degrees. In Experimental Example 2-1, the influence of the inclined fins 22 upon the length of transport of the developer in the direction of transport Ya is measured. Specifically, a solid image intended for size A3 is formed, whereby the developing device Gy is activated. In this image forming operation, an image of the developing sleeve 12 is taken with a video camera as an exemplary observation member from the side of the photoconductor drum PRy. In Experimental Example 2-1, another developer having a color different from the Y-color is added to a predetermined position of the developing sleeve 12. Then, after a predetermined period of time, any positions where the colors of the two developers are mixed on the developing sleeve 12 are observed on the image taken with the video camera. In other words, the length of transport of the developer in the axial direction of the developing roller R0*y* is measured on the basis of the position where the other developer has been added, the time elapsed, and any positions where the mixture of the two developers has appeared on the developing sleeve 12. In Experimental Example 2-1, the process speed is set to 126 mm/s. That is, the speed at which the sheet S passes through the second transfer area Q4 is set to 126 mm/s, and the speed of rotation of the developing sleeve 12 is set to 214.2 mm/s. The other conditions and the measurement method are the same as those employed in Experimental Example 1-1.

Experimental Example 2-2

In Experimental Example 2-2, the process speed is set to 63 mm/s. That is, the speed at which the sheet S passes through the second transfer area Q4 is set to 63 mm/s, and the speed of rotation of the developing sleeve 12 is set to 107.1 mm/s. The other conditions and the measurement method are the same as those employed in Experimental Example 2-1.

Comparative Example 2-1

In Comparative Example 2-1, the angle of inclination θ1 of each of the fins 22 included in the guiding-fin member 21 is set to 0 degrees. The other conditions and the measurement method are the same as those employed in Experimental Example 2-1.

Comparative Example 2-2

In Comparative Example 2-2, the angle of inclination θ1 of the fin 22 is set to 0 degrees. The other conditions and the measurement method are the same as those employed in Experimental Example 2-2.

Results of Experiments in Experimental Examples 2-1 and 2-2 and Comparative Examples 2-1 and 2-2

Figure 13:
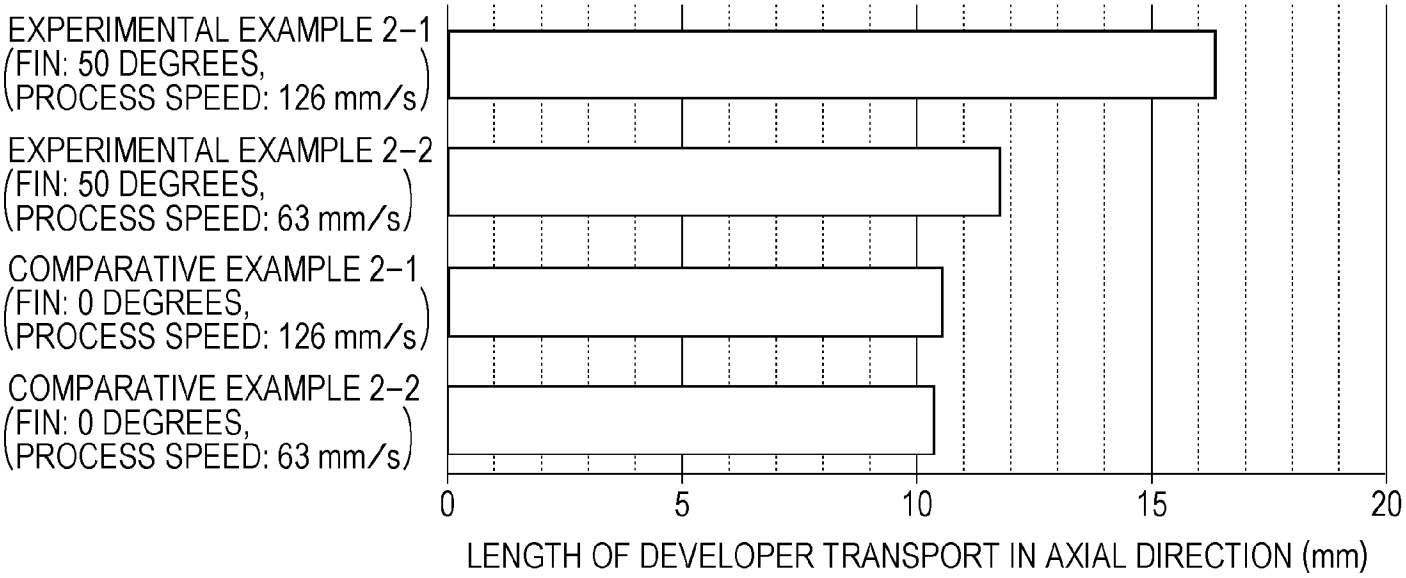
FIG. 13 is a graph illustrating the results of experiments conducted in Experimental Examples 2-1 and 2-2 and Comparative Examples 2-1 and 2-2.

FIG. 13 is a graph illustrating the results of the experiments conducted in Experimental Examples 2-1 and 2-2 and Comparative Examples 2-1 and 2-2.

Referring to FIG. 13, the length of transport of the developer in the direction of transport Ya is about 10 to 11 mm in each of Comparative Examples 2-1 and 2-2, in which the angle of inclination θ1 is 0 degrees. In contrast, the length of transport of the developer in the direction of transport Ya is about 12 mm in Experimental Example 2-2, in which the angle of inclination θ1 is 50 degrees and the process speed is 63 mm/s. Furthermore, the length of transport of the developer in the direction of transport Ya is about 16 mm in Experimental Example 2-1, in which the angle of inclination θ1 is 50 degrees and the process speed is 126 mm/s. That is, it is found that the developer moves in the direction of transport Ya by a larger length in the case where the angle of inclination θ1 is large at 50 degrees than in the case where the angle of inclination θ1 is 0 degrees. This is interpreted as that the developer is more likely to be guided in the direction of transport Ya in the case where the fins 22 of the guiding-fin member 21 incline.

In each of Experimental Examples 2-1 and 2-2, the angle of inclination θ1 is 50 degrees. In Experimental Example 2-2 in which the process speed is 63 mm/s, the length of transport of the developer is about 12 mm. On the other hand, in Experimental Example 2-1 in which the process speed is 126 mm/s, the length of transport of the developer is about 16 mm, which is larger than 12 mm. This means that, if the angle of inclination θ1 is the same, the length of transport of the developer in the direction of transport Ya becomes larger by increasing the process speed.

According to the results of the experiments conducted in Experimental Examples 1, as the angle of inclination θ1 becomes larger and as the process speed becomes higher, the difference in toner concentration ΔTC (%) in the direction of transport Ya tends to become smaller. That is, the results of the experiments in Experimental Examples 1 and 2 show a tendency that the larger the amount of developer guided in the direction of transport Ya, the smaller the difference in toner concentration ΔTC (%) of the developer in the direction of transport Ya.

In Experimental Examples 2-1 and 2-2 and in Comparative Examples 2-1 and 2-2, the length of transport of the developer on the developing sleeve 12 is observed. Hence, the sum of the length by which the guiding-fin member 21 has guided the developer and the length by which the supply auger 16 has transported the developer is measured. Therefore, considering the result of the measurement in Comparative Example 2-2, the length by which the supply auger 16 transports the developer in Experimental Example 2-2 in which the process speed is 63 mm/s is estimated to be about 10 mm. Furthermore, considering the result of the measurement in Comparative Example 2-1, the length by which the supply auger 16 transports the developer in Experimental Example 2-1 in which the process speed is 126 mm/s is estimated to be about 11 mm.

Second Exemplary Embodiment

A second exemplary embodiment of the present invention will now be described. Elements corresponding to those described in the first exemplary embodiment are denoted by the corresponding ones of the reference numerals used in the first exemplary embodiment, and detailed description thereof is omitted.

The second exemplary embodiment is basically the same as the first exemplary embodiment, except the following points.

Figure 14A:
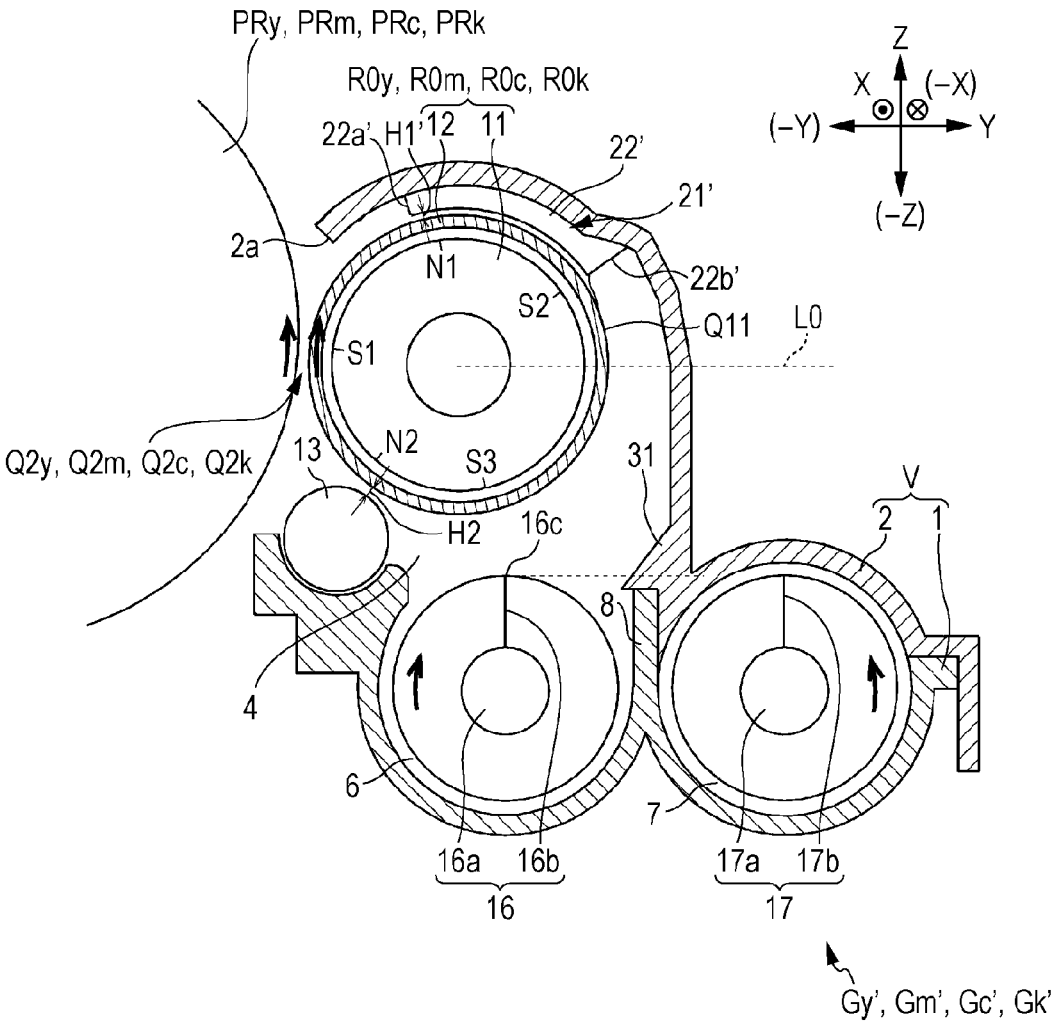
FIG. 14A illustrates the position of a guiding-fin member according to a second exemplary embodiment.
Figure 14B:
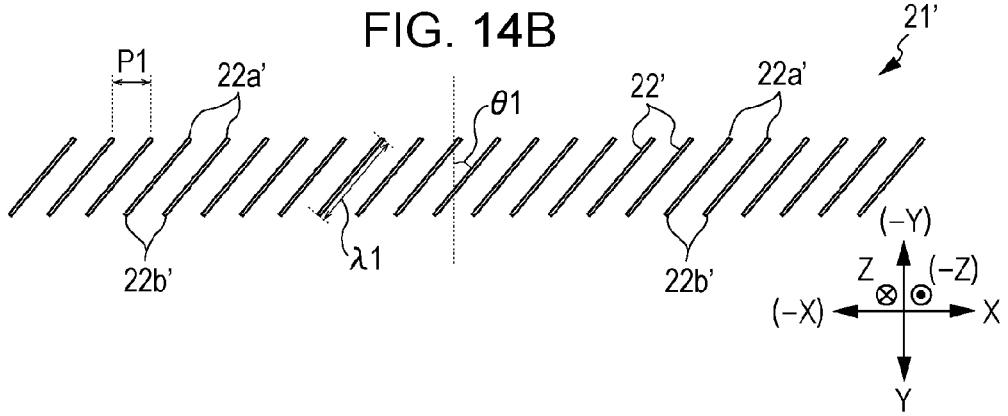
FIG. 14B is a bottom view of the guiding-fin member according to the second exemplary embodiment.

FIGS. 14A and 14B illustrate a guiding-fin member 21' included in a developing device Gy' according to the second exemplary embodiment. FIG. 14A illustrates the position of the guiding-fin member 21'. FIG. 14B is a bottom view of the guiding-fin member 21'.

Referring to FIGS. 14A and 14B, the guiding-fin member 21' as an exemplary developer guiding member according to the second exemplary embodiment is provided above the developing roller R0*y*, not on the lateral side of the developing roller R0*y*. Fins 22' included in the guiding-fin member 21' according to the second exemplary embodiment each have an arc shape conforming to the developing sleeve 12, with a gap H1' provided with respect to the outer surface of the developing sleeve 12. A left end 22*a*', as an exemplary upstream end in the direction of guiding of the developer, of each fin 22' is positioned in correspondence with the transport magnetic pole N1. In the second exemplary embodiment, the left end 22*a*' is positioned, in the direction of rotation of the developing sleeve 12, on the downstream side with respect to an opening 2*a* of the developer container V and near and on the upstream side with respect to the transport magnetic pole N1. A right end 22*b*', as an exemplary downstream end in the direction of guiding of the developer, of the fin 22' faces the pick-off magnetic pole S2.

The gap H1' (mm) according to the second exemplary embodiment is set to a value smaller than the thickness of a developer layer to be formed on the developing sleeve 12. Specifically, the gap H1' is set to a value smaller than the gap H2 between the trimmer 13 and the outer surface of the developing sleeve 12. Particularly, in the second exemplary embodiment, letting the tight bulk density of the developer be P (g/mm$^3$) and the preset amount of developer per unit area that is to be carried by the developing sleeve 12 be M (g/mm$^2$), the gap H1' is set to a value that satisfies the relationship of M/P>H1'. The term "tight bulk density" refers to the density of powder (the developer) that has been charged tightly into a container while being tapped. For reference, the density of powder that has been charged loosely into a container without being tapped is referred to as "loose bulk density."

Function of Guiding-Fin Member According to Second Exemplary Embodiment

In the developing device Gy' according to the second exemplary embodiment that is configured as described above, as the developing sleeve 12 rotates, the developer that has been attracted to the developing sleeve 12 from the supply chamber 6 is transported toward the downstream side in the direction of rotation of the developing sleeve 12. Specifically, the developer attracted to the developing sleeve 12 passes through the development area Q2*y* and is transported to the transport magnetic pole N1 and then to the pick-off magnetic pole S2. The guiding-fin member 21' of the developing device Gy' according to the second exemplary embodiment extends from a position on the upstream side with respect to the transport magnetic pole N1 to a position facing the pick-off magnetic pole S2. Hence, in the second exemplary embodiment, the developer that has passed through the development area Q2*y* and whose toner has been consumed enters the guiding-fin member 21' from the left ends 22*a*' of the fins 22'. Subsequently, the developer that has passed through the guiding-fin member 21' is released from the developing sleeve 12 at the position Q11 and drops into the supply chamber 6. In this process, the developer that is dropping may be guided by the guide member 31, occasionally.

The guiding-fin member 21' according to the second exemplary embodiment includes plural fins 22' each incline from the upstream side thereof in the direction of rotation of the developing sleeve 12 toward the downstream side in the direction of transport Ya, i.e., the axial direction of the developing roller R0*y*. Therefore, the developer that has entered the guiding-fin member 21' comes into contact with the fins 22' while moving toward the downstream side in the direction of rotation of the developing sleeve 12. Then, the developer that tends to move toward the downstream side in the direction of rotation of the developing sleeve 12 is guided toward the downstream side in the direction of transport Ya along the fins 22'. Hence, the developer that has passed through the guiding-fin member 21' tends to exit the guiding-fin member 21' from a position on the downstream side in the direction of transport Ya with respect to the position of entry into the guiding-fin member 21'. Thus, in the second exemplary embodiment, the developer tends to be released from the developing sleeve 12, before returning to the supply chamber 6, at a position on the downstream side in the direction of transport Ya with respect to the position of attraction to the developing sleeve 12. Therefore, in the second exemplary embodiment, the developer whose toner has been consumed easily move toward the downstream side in the direction of transport Ya before returning to the supply chamber 6, as in the first exemplary embodiment. Consequently, in the developing device Gy' according to the second exemplary embodiment that has a small size, the difference in toner concentration ΔTC (%) of the developer in the axial direction of the developing roller R0*y* tends to be suppressed, as in the first exemplary embodiment.

The guiding-fin member 21' according to the second exemplary embodiment is configured to guide the developer on the developing sleeve 12 in the direction of transport Ya. In the first exemplary embodiment, the guiding-fin member 21 is provided on the lateral side of the developing roller R0*y*, and the developer that has been released from the developing sleeve 12 is introduced into and is guided by the guiding-fin member 21. In general, if the process speed is changed and the speed of rotation of the developing sleeve 12 is therefore changed, the centrifugal force that acts on the developer changes and the position and the speed of release of the developer from the developing sleeve 12 also change, accordingly. Consequently, the position from which the developer released from the developing sleeve 12 enters the guiding-fin member 21 and the amount of developer that enters the guiding-fin member 21 change. That is, in the first exemplary embodiment, the length by which the developer is guided in the direction of transport Ya and the amount of developer that is guided by the guiding-fin member 21 may change with the process speed. On the other hand, the guiding-fin member 21' according to the second exemplary embodiment is held above the developing sleeve 12 and comes into contact with and guides the developer that is moving toward the downstream side in the direction of rotation of the developing sleeve 12. Hence, even if the process speed is changed, the amount of developer that enters the guiding-fin member 21' is less likely to change. Moreover, the axial-direction position of entry of the developer into the guiding-fin member 21' and the length of guiding of the developer in the direction of transport Ya are less likely to change. Hence, in the second exemplary embodiment, the length of guiding of the developer in the direction of transport Ya and the amount of developer to be guided are more stabilized for a wider range of process speed than in the case where the developer is guided after being released from the developing sleeve 12.

In the second exemplary embodiment, the gap H1' between the guiding-fin member 21' and the developing sleeve 12 is set on the basis of the tight bulk density P of the developer. The guiding-fin member 21' according to the second exemplary embodiment needs to come into contact with the developer on the developing sleeve 12. Hence, in the second exemplary embodiment, the gap H1' between the guiding-fin member 21' and the developing sleeve 12 is set to a value smaller than the thickness of the developer layer to be formed on the developing sleeve 12. Particularly, the guiding-fin member 21' according to the second exemplary embodiment is positioned such that the gap H1' satisfies the relationship of M/P>H1', where P denotes the tight bulk density of the developer, and M denotes the preset amount of developer per unit area of the developing sleeve 12. That is, the gap H1' is set to a value smaller than M/P, which is the thickness of the developer layer based on a tight bulk density. In general, a centrifugal force and so forth act on the developing sleeve 12, and the developer that is present on the developing sleeve 12 has a larger thickness than the thickness based on the tight bulk density. Therefore, if the gap H1' satisfies the relationship of M/P>H1', the guiding-fin member 21' assuredly comes into contact with the developer. Thus, in the second exemplary embodiment, the guiding-fin member 21' assuredly comes into contact with the developer on the developing sleeve 12, and the developer is easily guided by the guiding-fin member 21'.

Third Exemplary Embodiment

A third exemplary embodiment of the present invention will now be described. Elements corresponding to those described in the first exemplary embodiment are denoted by the corresponding ones of the reference numerals used in the first exemplary embodiment, and detailed description thereof is omitted.

The third exemplary embodiment is basically the same as the first exemplary embodiment, except the following points.

Figure 15:
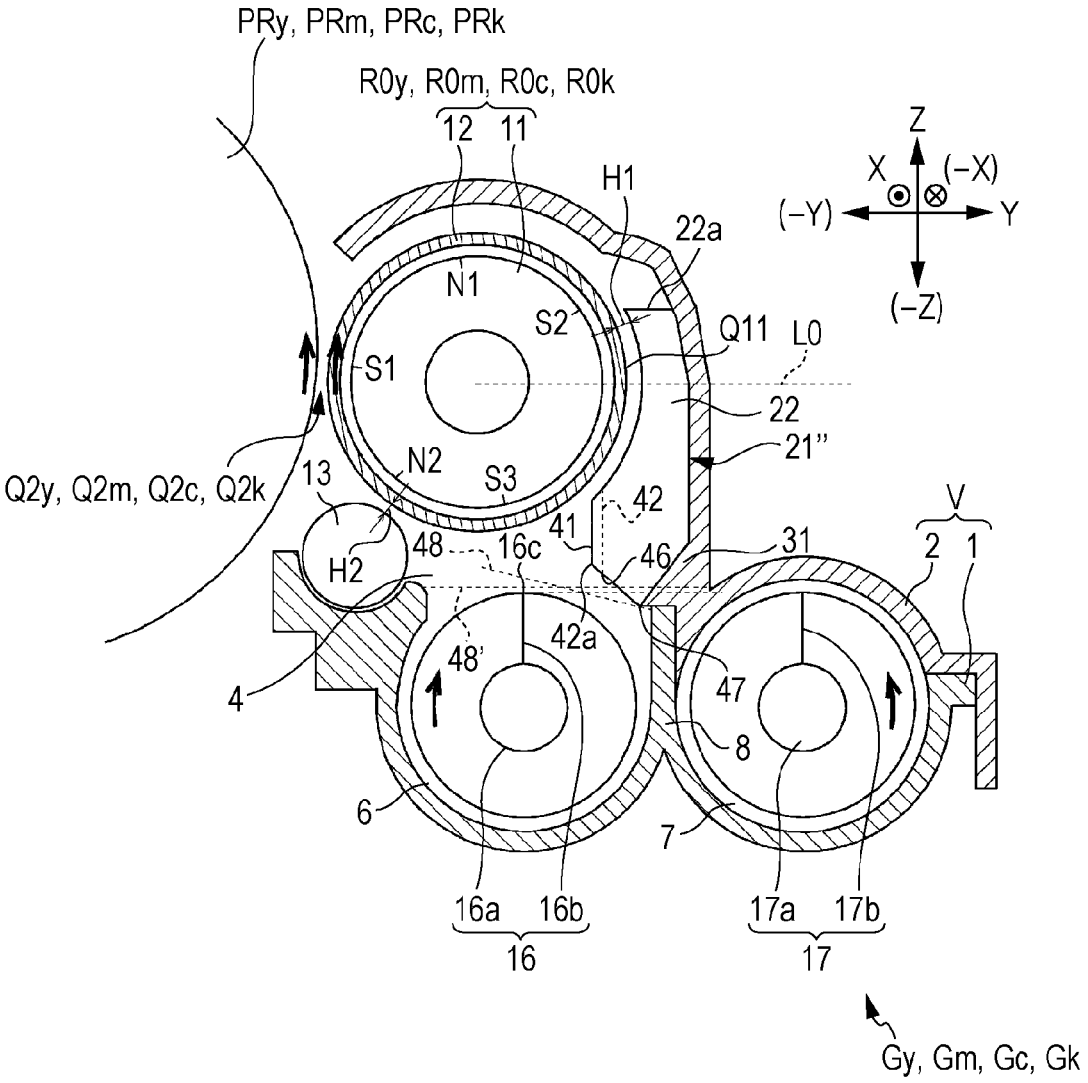
FIG. 15 illustrates a developing device according to a third exemplary embodiment and corresponds to FIG. 3 illustrating the developing device according to the first exemplary embodiment.

FIG. 15 illustrates a developing device Gy according to the third exemplary embodiment and corresponds to FIG. 3 illustrating the first exemplary embodiment.

Figure 16:
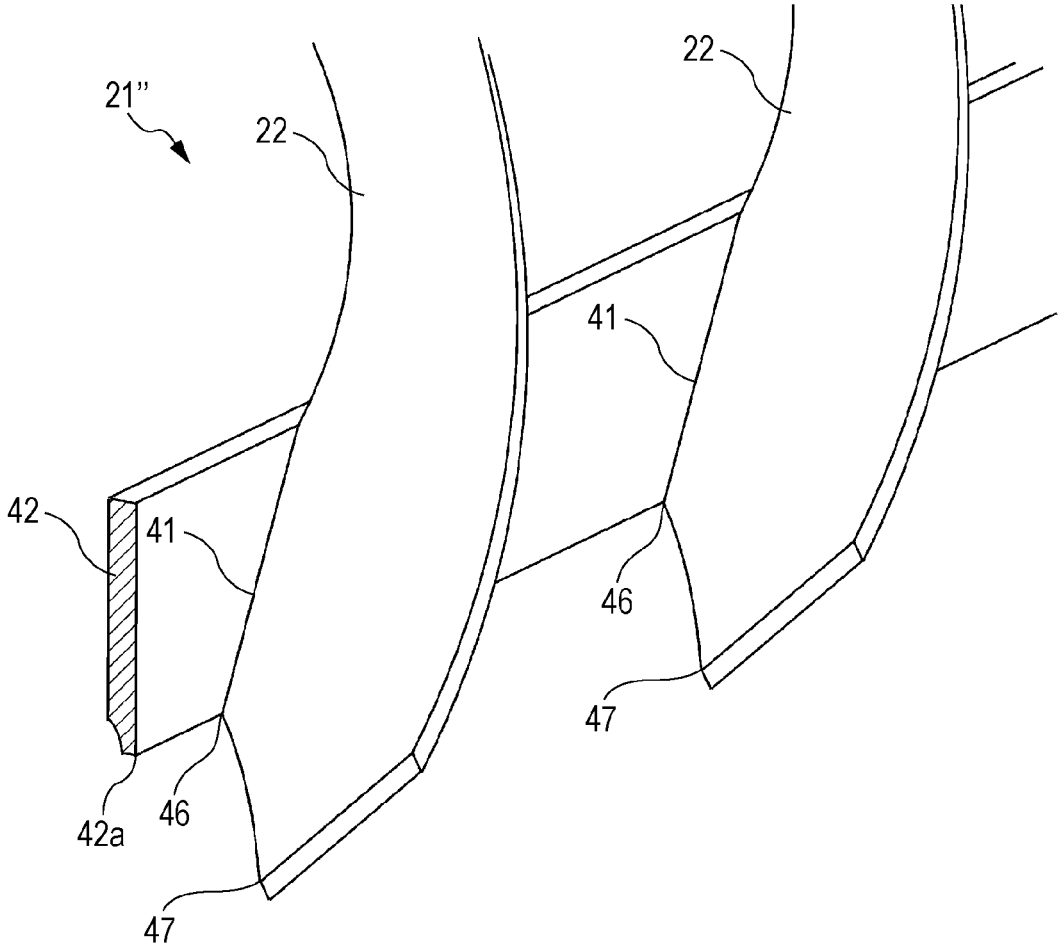
FIG. 16 is a perspective view of relevant parts included in a guiding-fin member according to the third exemplary embodiment.

FIG. 16 is a perspective view of relevant parts included in a guiding-fin member 21" according to the third exemplary embodiment.

Referring to FIGS. 15 and 16, the guiding-fin member 21" according to the third exemplary embodiment is provided with a guiding wall 42 as an exemplary stopping member that extends over downstream ends 41, in the direction of rotation of the developing roller R0*y*, of the respective fins 22 thereof. The guiding wall 42 according to the third exemplary embodiment has a plate-like shape that is flat in the vertical direction and in the anteroposterior direction.

A lower end 42*a* of the guiding wall 42 is positioned at a distance longer than the radius of the rotating shaft 16*a* from the center of rotation of the supply auger 16 in the horizontal direction.

Referring to FIG. 15, a lower end portion of each of the fins 22 of the guiding-fin member 21" according to the third exemplary embodiment includes a left end 46 and a lowest end 47. The left end 46 is nearer to the developing roller R0*y* and is at a higher position than the lowest end 47.

As illustrated in FIG. 15 in a sectional view taken perpendicularly to the axial direction of the supply auger 16, the lowest end 47 of each of the fins 22 of the guiding-fin member 21" according to the third exemplary embodiment is positioned on the right side, on which the transporting blade 16*b* of the supply auger 16 moves from the upper side toward the lower side in the gravitational direction.

The lowest end 47 of each of the fins 22 of the guiding-fin member 21" according to the third exemplary embodiment is positioned above a top surface 48 of the mass of developer that is formed when the supply auger 16 is rotating.

Function of Guiding-Fin Member According to Third Exemplary Embodiment

In the developing device Gy according to the third exemplary embodiment that is configured as described above, the developer that has been released from the developing roller R0*y* is guided by the guiding-fin member 21" toward the downstream side in the direction of transport Ya by the supply auger 16. In this process, as the speed of rotation of the developing roller R0*y* increases, the centrifugal force that acts on the developer increases. Accordingly, when the developing sleeve 12 rotates at a high speed, the developer is easily released from the developing sleeve 12.

If the sheet S is a cardboard, the sheet S is transported at a low speed so that, for example, the occurrence of defective fixing is suppressed. Correspondingly, the developing sleeve 12 rotates at a low speed. In such a case, the centrifugal force that acts on the developer is reduced. Consequently, the developer is less likely to be released from the developing sleeve 12, and the position of release of the developer is shifted toward the pickup magnetic pole S3.

That is, if the guiding wall 42 is not provided, the position from which the developer that has been released from the developing sleeve 12 drops off the developing sleeve 12 is shifted toward the position from which the developer is picked up. Such a situation tends to increase the amount of developer that is reattracted to the supply auger 16 after dropping off the developing sleeve 12 without being transported by a satisfactory length in the axial direction of the supply auger 16. Accordingly, the average length of transport of the developer tends to be insufficient.

In the third exemplary embodiment, however, since the guiding wall 42 is provided, the developer that has been released from a position nearer to the pickup magnetic pole S3 is also guided downward by the guiding wall 42. Therefore, the position from which the developer drops is satisfactorily far from the position of pickup of the developer. Accordingly, the developer is more easily transported in the axial direction of the supply auger 16 before being reattracted to the developing sleeve 12. Thus, in the third exemplary embodiment, the difference between the toner concentration of the developer on the upstream side and the toner concentration of the developer on the downstream side in the direction of transport Ya is smaller than in the first exemplary embodiment.

Particularly, in the third exemplary embodiment, the lower end 42*a* of the guiding wall 42 is positioned at a distance longer than the radius of the rotating shaft 16*a* from the center of rotation of the supply auger 16 in the horizontal direction. That is, the developer that has been guided by the guiding wall 42 drops onto the right side of the supply auger 16. The developer that has dropped onto the right side of the supply auger 16 moves along with the rotation of the supply auger 16 sequentially from the right side, to the lower side, to the left side, and to the upper side of the rotating shaft 16*a*. Hence, the developer tends to be transported by a long length in the direction of transport by the supply auger 16 before being reattracted to the developing sleeve 12.

In the third exemplary embodiment, each fin 22 of the guiding-fin member 21" has the left end 46 that is at a higher position than the lowest end 47 thereof. Such a shape allows the guiding-fin member 21" to extend up to a lower position than in the first exemplary embodiment where the lower end of the guiding-fin member 21 extends horizontally. Therefore, the length of guiding of the developer by the guiding-fin member 21" is longer than in the first exemplary embodiment. Accordingly, the length of guiding of the developer toward the downstream side in the axial direction of the supply auger 16 is longer than in the first exemplary embodiment. Consequently, it becomes much easier to reduce the difference in toner concentration of the developer than in the case of the guiding-fin member 21 including the fins 22 that each do not have the lowest end 47 and the left end 46.

The lowest end 47 of the fin 22 of the guiding-fin member 21" according to the third exemplary embodiment is positioned above the top surface 48 of the mass of developer that is formed when the supply auger 16 is rotating. If the lowest end 47 of the fin 22 of the guiding-fin member 21" is positioned below the top surface 48 of the mass of developer, the guiding-fin member 21" hinders the transport of the developer. In the third exemplary embodiment, however, the guiding-fin member 21" is prevented from hindering the transport of the developer.

When the supply auger 16 is rotating, the top surface 48 of the mass of developer inclines as illustrated in FIG. 15 along with the rotation of the supply auger 16. When the supply auger 16 is not rotating, the mass of developer has a top surface 48' that is substantially horizontal. Even if the guiding-fin member 21" comes into contact with the developer when the supply auger 16 is not rotating, there is no problem. In the third exemplary embodiment, the lowest end 47 of the fin 22 of the guiding-fin member 21" is positioned above the top surface 48 of the mass of developer that is formed when the supply auger 16 is rotating and below the top surface 48' of the mass of developer that is formed when the supply auger 16 is not rotating. Therefore, the lowest end 47 of the fin 22 of the guiding-fin member 21" is positioned much lower than in a case where the lowest end 47 of the fin 22 of the guiding-fin member 21" is positioned above the top surface 48' of the mass of developer that is formed when the supply auger 16 is not rotating.

Examples 3

Experiments for demonstrating the effects of providing the guiding wall 42 according to the third exemplary embodiment are conducted in Experimental Examples 3 and in Comparative Examples 3.

Experimental Examples 3 are basically the same as Experimental Examples 2, except that the amount of developer sump in each of the developing devices Gy is 90 g.

Experimental Example 3-1

In Experimental Example 3-1, the developing device Gy includes the guiding wall 42, the angle of inclination θ1 of the fin 22 is set to 50 degrees, and the process speed is set to 126 mm/s.

Experimental Example 3-2

In Experimental Example 3-2, the developing device Gy includes the guiding wall 42, the angle of inclination θ1 of the fin 22 is set to 50 degrees, and the process speed is set to 63 mm/s.

Experimental Example 3-3

Experimental Example 3-3 is based on the same conditions as Experimental Example 2-1. That is, the developing device Gy does not include the guiding wall 42, the angle of inclination θ1 of the fin 22 is set to 50 degrees, and the process speed is set to 126 mm/s.

Experimental Example 3-4

Experimental Example 3-4 is based on the same conditions as Experimental Example 2-2. That is, the developing device Gy does not include the guiding wall 42, the angle of inclination θ1 of the fin 22 is set to 50 degrees, and the process speed is set to 63 mm/s.

Comparative Example 3-1

Comparative Example 3-1 is based on the same conditions as Comparative Example 2-1. That is, the developing device Gy does not include the guiding wall 42, the angle of inclination θ1 of the fin 22 is set to 0 degrees, and the process speed is set to 126 mm/s.

Comparative Example 3-2

Comparative Example 3-2 is based on the same conditions as Comparative Example 2-2. That is, the developing device Gy does not include the guiding wall 42, the angle of inclination θ1 of the fin 22 is set to 0 degrees, and the process speed is set to 63 mm/s.

Figure 17:
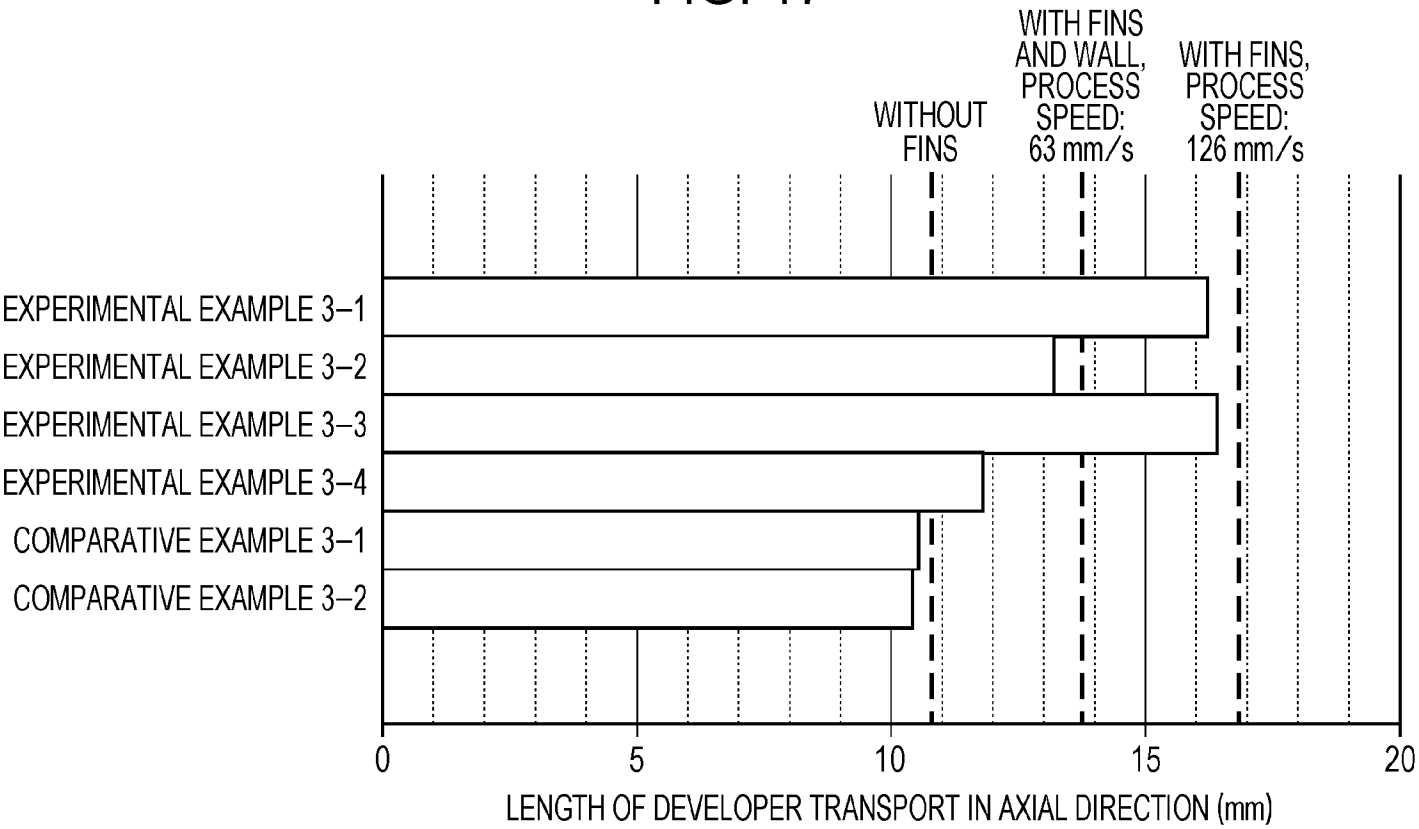
FIG. 17 is a bar graph illustrating the results of experiments conducted in Experimental and Comparative Examples 3, with the horizontal axis representing the length of transport of the developer in the axial direction of the developing roller.

The results of the experiments are illustrated in FIG. 17.

FIG. 17 is a bar graph illustrating the results of experiments conducted in Experimental and Comparative Examples 3, with the horizontal axis representing the length of transport of the developer in the axial direction.

Referring to FIG. 17, the results of Experimental Examples 3-1 and 3-3 show that, if the process speed is high, the length of transport of the developer is substantially the same, that is, there is substantially no effect of providing the guiding wall 42. In contrast, the results of Experimental Examples 3-2 and 3-4 show that, if the process speed is low, the length of transport of the developer increases by providing the guiding wall 42. Furthermore, the results of Experimental Examples 3-2 and 3-4 and Comparative Examples 3-1 and 3-2 show that providing the guiding-fin member 21" increases the length of transport of the developer as in Experimental Examples 2, and that providing the guiding wall 42 further increases the length of transport of the developer.

Modifications

While some exemplary embodiments of the present invention have been described above in detail, the present invention is not limited to the above exemplary embodiments. Various modifications may be made to the above exemplary embodiments within the scope of the present invention that is defined by the appended claims. Exemplary modifications (H01) to (H010) of the present invention will now be described below.

Modification (H01)

While each of the above exemplary embodiments concerns a case where the image forming apparatus is a copier, the present invention is not limited to such a case. For example, the image forming apparatus may be a printer or a facsimile, or a multifunction machine having plural or all of the functions of the foregoing apparatuses.

Modification (H02)

While each of the above exemplary embodiments concerns a case where the copier U uses developers having four respective colors, the present invention is not limited to such a case. For example, the present invention is also applicable to a monochrome image forming apparatus or to a multicolor image forming apparatus using five or more colors or three or less colors.

Modification (H03)

While each of the first and second exemplary embodiments concerns a case where either the guiding-fin member 21 or the guiding-fin member 21' is provided, the present invention is not limited to such a case. The developing device Gy or Gy' may include both the guiding-fin member 21 and the guiding-fin member 21'. In that case, the guiding-fin member 21 and the guiding-fin member 21' may be combined as an integral body, instead of being provided as separate members.

Modification (04)

In each of the above exemplary embodiment, the pitch P1 of the fins 22 or 22' is desired to be smaller than the pitch P2 of the turns in the transporting blade 16*b* of the supply auger 16. However, the present invention is not limited to such a case. If the total amount of developer to be transported in the supply chamber 6 is satisfactorily larger than the amount of developer to be guided by the fins 22 or 22', the pitch P1 may be larger than the pitch P2.

Modification (H05)

In each of the above exemplary embodiments, the angle of inclination θ1 is desired to be 20 degrees or about 20 degrees or larger and smaller than or equal to the complementary angle of the angle of repose of the developer. However, the present invention is not limited to such a case. For example, the angle of inclination θ1 may be larger than the complementary angle of the angle of repose of the developer if the developer is less likely to accumulate on the fins 22 and the movement of the developer in the guiding-fin member 21, 21', or 21" is less likely to be hindered, owing to a certain level of force of inertia that releases the developer from the developing sleeve 12 or a force of transporting the developer that is exerted by the developing sleeve 12.

Modification (H06)

In the first exemplary embodiment, the guiding-fin member 21 is desired to be provided such that the upper end 22*a* thereof is positioned in the area defined by the half-value width W of the distribution of the magnetic force exerted by the pick-off magnetic pole S2. Alternatively, the upper end 22*a* may be provided on the outside of the area defined by the half-value width W.

Modification (H07)

While the first exemplary embodiment concerns a case where the gap H1 provided between the guiding-fin member 21 and the outer surface of the developing sleeve 12 is larger than the gap H2 provided between the trimmer 13 and the outer surface of the developing sleeve 12, the present invention is not limited to such a case. The guiding-fin member 21 may be in contact with the developer on the developing sleeve 12.

Modification (H08)

While the third exemplary embodiment concerns a case where the guiding wall 42 is flat in the vertical direction, the present invention is not limited to such a case. For example, the guiding wall 42 may incline with respect to the vertical direction. Moreover, the guiding wall 42 is not limited to have a flat shape and may have a curved shape.

Modification (H09)

In the third exemplary embodiment, the lower end 42*a* of the guiding wall 42 is desired to be positioned at a distance longer than the radius of the rotating shaft 16*a* from the center of rotation of the supply auger 16 in the horizontal direction. Depending on the position of the pickup magnetic pole S3 and other factors, the position of the lower end 42*a* may be changed to a position exactly above the rotating shaft 16*a*, or the like position.

Modification (H010)

In the third exemplary embodiment, the lowest end 47 of each fin 22 of the guiding-fin member 21" is desired to be positioned below the top surface 48' of the mass of developer that is formed when the supply auger 16 is not rotating. However, the present invention is not limited to such a case. The lowest end 47 may be positioned above the top surface 48'.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer container that contains developer;

a developer carrier provided in the developer container and that is rotatable while carrying the developer on a surface, the developer carrier facing an image carrier on which a latent image is to be formed;

a first transporting member including a rotating shaft and a transporting blade supported by the rotating shaft, the first transporting member configured to transport the developer in the developer container while stirring the developer; and a second transporting member including a rotating shaft and a transporting blade supported by the rotating shaft, the second transporting member being provided side by side with the first transporting member, the second transporting member configured to transport the developer, while stirring the developer, in a direction opposite to a direction of transport by the first transporting member, wherein the rotating shaft of the first transporting member is positioned in an area of projection defined by projecting the developer carrier from an upper side in a gravitational direction, wherein, a first virtual tangent to an outer surface of the developer carrier extends in the gravitational direction on a side of the developer carrier opposite the image carrier and that a second virtual tangent to an outer edge of the transporting blade of the first transporting member extends in the gravitational direction on a side of the first transporting member opposite the image carrier, the second virtual tangent is farther from the image carrier in a horizontal direction than the first virtual tangent, wherein, a distance in the horizontal direction between the first virtual tangent and the second virtual tangent is a first distance, and a distance in the horizontal direction between the first virtual tangent and an inner surface of the developer container on the side of the developer carrier opposite the image carrier is a second distance, the first distance is shorter than the second distance, wherein a developer guiding member that is configured to guide the developer moving along the developer carrier is provided on a downstream side in a direction of rotation of the developer carrier with respect to a facing area where the developer carrier faces the image carrier, wherein the developer guiding member faces the outer surface of the developer carrier with a gap interposed between the developer guiding member and the outer surface of the developer carrier, and wherein the developer guiding member includes an inclined portion that inclines from an upstream side in the direction of rotation of the developer carrier toward a downstream side in the direction of transport by the first transporting member, and wherein the inclined portion of the developer guiding member is one of a plurality of inclined portions, the plurality of inclined portions being arranged at a pitch smaller than a pitch of turns in the transporting blade of the first transporting member.

2. The developing device according to claim 1, wherein the plurality of inclined portions are arranged at a predetermined pitch in an axial direction of the developer carrier.

3. The developing device according to claim 1, wherein an angle of inclination of the inclined portion with respect to a direction orthogonal to an axial direction of the developer carrier is about 20 degrees or larger and smaller than or equal to a complementary angle of an angle of repose of the developer.

4. The developing device according to claim 1, wherein, in a section perpendicular to an axial direction of the first transporting member, a lower end of the developer guiding member is positioned on a side of the first transporting member on which the transporting blade of the first transporting member moves from an upper side toward a lower side in the gravitational direction, and wherein the lower end of the developer guiding member is positioned above a top surface of a mass of developer that is formed when the first transporting member is rotating.

5. A visible-image-forming device comprising:

an image carrier configured to carry a latent image on a surface; and the developing device according to claim 1 that develops the latent image on the surface of the image carrier into a visible image.

6. An image forming apparatus comprising:

an image carrier configured to carry a latent image on a surface;

the developing device according to claim 1 that develops the latent image on the surface of the image carrier into a visible image;

a transfer device configured to transfer the visible image to a medium; and a fixing device configured to fix the visible image transferred to the medium to the medium.

7. A developing device comprising:

a developer container that contains developer;

a developer carrier provided in the developer container and that is rotatable while carrying the developer on a surface, the developer carrier facing an image carrier on which a latent image is to be formed;

a first transporting member including a rotating shaft and a transporting blade supported by the rotating shaft, the first transporting member configured to transport the developer in the developer container while stirring the developer; and a second transporting member including a rotating shaft and a transporting blade supported by the rotating shaft, the second transporting member being provided side by side with the first transporting member, the second transporting member configured to transport the developer, while stirring the developer, in a direction opposite to a direction of transport by the first transporting member, wherein the rotating shaft of the first transporting member is positioned in an area of projection defined by projecting the developer carrier from an upper side in a gravitational direction, wherein, a first virtual tangent to an outer surface of the developer carrier extends in the gravitational direction on a side of the developer carrier opposite the image carrier and that a second virtual tangent to an outer edge of the transporting blade of the first transporting member extends in the gravitational direction on a side of the first transporting member opposite the image carrier, the second virtual tangent is farther from the image carrier in a horizontal direction than the first virtual tangent, wherein, a distance in the horizontal direction between the first virtual tangent and the second virtual tangent is a first distance, and a distance in the horizontal direction between the first virtual tangent and an inner surface of the developer container on the side of the developer carrier opposite the image carrier is a second distance, the first distance is shorter than the second distance, wherein a developer guiding member that is configured to guide the developer moving along the developer carrier is provided on a downstream side in a direction of rotation of the developer carrier with respect to a facing area where the developer carrier faces the image carrier, wherein the developer guiding member faces the outer surface of the developer carrier with a gap interposed between the developer guiding member and the outer surface of the developer carrier, wherein the developer guiding member includes an inclined portion that inclines from an upstream side in the direction of rotation of the developer carrier toward a downstream side in the direction of transport by the first transporting member, wherein the developer carrier includes a fixed magnet member; and a rotating body rotatably supported on an outer side of the magnet member and that is configured to carry the developer, wherein the magnet member has a development magnetic pole defined at a position in a facing area where the developer carrier faces the image carrier;

a transport magnetic pole that is of an opposite polarity to the development magnetic pole and is defined on a downstream side with respect to the development magnetic pole in a direction of rotation of the rotating body; and a developer-release magnetic pole that is of an opposite polarity to the transport magnetic pole and is defined on the downstream side with respect to the transport magnetic pole in the direction of rotation of the rotating body, and wherein an upstream end of the developer guiding member in a direction of guiding of the developer is positioned between an upstream-end position and a downstream-end position of an area of the rotating body, the area being defined by a half-value width of a distribution of a magnetic force exerted by the developer-release magnetic pole, the magnetic force being half a maximum value in a direction normal to the rotating body at each of the upstream-end position and the downstream-end position.

8. A developing device comprising:

a developer container that contains developer;

a developer carrier provided in the developer container and that is rotatable while carrying the developer on a surface, the developer carrier facing an image carrier on which a latent image is to be formed;

a first transporting member including a rotating shaft and a transporting blade supported by the rotating shaft, the first transporting member configured to transport the developer in the developer container while stirring the developer; and a second transporting member including a rotating shaft and a transporting blade supported by the rotating shaft, the second transporting member being provided side by side with the first transporting member, the second transporting member configured to transport the developer, while stirring the developer, in a direction opposite to a direction of transport by the first transporting member, wherein the rotating shaft of the first transporting member is positioned in an area of projection defined by projecting the developer carrier from an upper side in a gravitational direction, wherein, a first virtual tangent to an outer surface of the developer carrier extends in the gravitational direction on a side of the developer carrier opposite the image carrier and that a second virtual tangent to an outer edge of the transporting blade of the first transporting member extends in the gravitational direction on a side of the first transporting member opposite the image carrier, the second virtual tangent is farther from the image carrier in a horizontal direction than the first virtual tangent, wherein, a distance in the horizontal direction between the first virtual tangent and the second virtual tangent is a first distance, and a distance in the horizontal direction between the first virtual tangent and an inner surface of the developer container on the side of the developer carrier opposite the image carrier is a second distance, the first distance is shorter than the second distance, wherein a developer guiding member that is configured to guide the developer moving along the developer carrier is provided on a downstream side in a direction of rotation of the developer carrier with respect to a facing area where the developer carrier faces the image carrier, wherein the developer guiding member faces the outer surface of the developer carrier with a gap interposed between the developer guiding member and the outer surface of the developer carrier, wherein the developer guiding member includes an inclined portion that inclines from an upstream side in the direction of rotation of the developer carrier toward a downstream side in the direction of transport by the first transporting member, wherein the developer carrier includes a fixed magnet member; and a rotating body rotatably supported on an outer side of the magnet member and configured to carry the developer, wherein the magnet member has a development magnetic pole defined at a position in a facing area where the developer carrier faces the image carrier;

a transport magnetic pole that is of an opposite polarity to the development magnetic pole and is defined on a downstream side with respect to the development magnetic pole in a direction of rotation of the rotating body; and a developer-release magnetic pole that is of an opposite polarity to the transport magnetic pole and is defined on the downstream side with respect to the transport magnetic pole in the direction of rotation of the rotating body, and wherein an upstream end of the developer guiding member in a direction of guiding of the developer is positioned between a position facing the development magnetic pole and a position facing the developer-release magnetic pole.

9. A developing device comprising:

a developer container that contains developer;

a developer carrier provided in the developer container and that is rotatable while carrying the developer on a surface, the developer carrier facing an image carrier on which a latent image is to be formed;

a first transporting member including a rotating shaft and a transporting blade supported by the rotating shaft, the first transporting member configured to transport the developer in the developer container while stirring the developer; and a second transporting member including a rotating shaft and a transporting blade supported by the rotating shaft, the second transporting member being provided side by side with the first transporting member, the second transporting member configured to transport the developer, while stirring the developer, in a direction opposite to a direction of transport by the first transporting member; and a stopping member configured to cover a downstream-end portion of a developer guiding member in the direction of rotation of the developer carrier, wherein the rotating shaft of the first transporting member is positioned in an area of projection defined by projecting the developer carrier from an upper side in a gravitational direction, wherein, a first virtual tangent to an outer surface of the developer carrier extends in the gravitational direction on a side of the developer carrier opposite the image carrier and that a second virtual tangent to an outer edge of the transporting blade of the first transporting member extends in the gravitational direction on a side of the first transporting member opposite the image carrier, the second virtual tangent is farther from the image carrier in a horizontal direction than the first virtual tangent, wherein, a distance in the horizontal direction between the first virtual tangent and the second virtual tangent is a first distance, and a distance in the horizontal direction between the first virtual tangent and an inner surface of the developer container on the side of the developer carrier opposite the image carrier is a second distance, the first distance is shorter than the second distance, wherein the developer guiding member that is configured to guide the developer moving along the developer carrier is provided on a downstream side in a direction of rotation of the developer carrier with respect to a facing area where the developer carrier faces the image carrier, wherein the developer guiding member faces the outer surface of the developer carrier with a gap interposed between the developer guiding member and the outer surface of the developer carrier, and wherein the developer guiding member includes an inclined portion that inclines from an upstream side in the direction of rotation of the developer carrier toward a downstream side in the direction of transport by the first transporting member.

10. The developing device according to claim 9, wherein a lower end of the stopping member is positioned at a distance from a center of rotation of the first transporting member by a length in the horizontal direction that is longer than a radius of the rotating shaft of the first transporting member.

11. A developing device comprising:

a developer container that contains developer;

a developer carrier provided in the developer container and that is rotatable while carrying the developer on a surface, the developer carrier facing an image carrier on which a latent image is to be formed;

a first transporting member including a rotating shaft and a transporting blade supported by the rotating shaft, the first transporting member configured to transport the developer in the developer container while stirring the developer; and a second transporting member including a rotating shaft and a transporting blade supported by the rotating shaft, the second transporting member being provided side by side with the first transporting member, the second transporting member configured to transport the developer, while stirring the developer, in a direction opposite to a direction of transport by the first transporting member, wherein the rotating shaft of the first transporting member is positioned in an area of projection defined by projecting the developer carrier from an upper side in a gravitational direction, wherein, a first virtual tangent to an outer surface of the developer carrier extends in the gravitational direction on a side of the developer carrier opposite the image carrier and that a second virtual tangent to an outer edge of the transporting blade of the first transporting member extends in the gravitational direction on a side of the first transporting member opposite the image carrier, the second virtual tangent is farther from the image carrier in a horizontal direction than the first virtual tangent, wherein, a distance in the horizontal direction between the first virtual tangent and the second virtual tangent is a first distance, and a distance in the horizontal direction between the first virtual tangent and an inner surface of the developer container on the side of the developer carrier opposite the image carrier is a second distance, the first distance is shorter than the second distance, wherein a developer guiding member that is configured to guide the developer moving along the developer carrier is provided on a downstream side in a direction of rotation of the developer carrier with respect to a facing area where the developer carrier faces the image carrier, wherein the developer guiding member faces the outer surface of the developer carrier with a gap interposed between the developer guiding member and the outer surface of the developer carrier, wherein the developer guiding member includes an inclined portion that inclines from an upstream side in the direction of rotation of the developer carrier toward a downstream side in the direction of transport by the first transporting member, and wherein the developer guiding member has a lower end and a lowest end, the lower end being nearer to the developer carrier and at a higher position than the lowest end.

* * * * *